US010060403B2

(12) United States Patent
Fujita

(10) Patent No.: US 10,060,403 B2
(45) Date of Patent: Aug. 28, 2018

(54) SYSTEM FOR CONTROLLING STARTING OF ENGINE

(71) Applicant: DENSO CORPORATION, Kariya, Aichi-pref. (JP)

(72) Inventor: Tatsuya Fujita, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/592,499

(22) Filed: May 11, 2017

(65) Prior Publication Data

US 2017/0328326 A1 Nov. 16, 2017

(30) Foreign Application Priority Data

May 12, 2016 (JP) ..... 2016-096304

(51) Int. Cl.
*F02N 11/00* (2006.01)
*F02D 41/06* (2006.01)
*F02N 11/08* (2006.01)

(52) U.S. Cl.
CPC ..... *F02N 11/006* (2013.01); *F02D 41/061* (2013.01); *F02D 41/062* (2013.01); *F02N 11/0848* (2013.01); *F02D 2200/101* (2013.01); *F02D 2200/501* (2013.01); *F02D 2200/602* (2013.01); *F02N 2200/02* (2013.01)

(58) Field of Classification Search
CPC ..... F02D 41/06; F02D 41/061; F02D 41/062; F02N 11/00; F02N 11/06; F02N 11/08; F02N 11/0848; F02N 2200/02; Y02T 10/6213; Y02T 10/6286
USPC ... 123/179.1, 179.19, 179, 28, 179.3, 179.4, 123/198 D; 701/112–114
See application file for complete search history.

(56) References Cited

U.S. PATENT DOCUMENTS

| | | | | |
|---|---|---|---|---|
| 6,396,165 | B1 | 5/2002 | Nagano et al. | |
| 9,115,681 | B2 * | 8/2015 | Nakamura | F02N 11/006 |
| 9,140,201 | B2 * | 9/2015 | Kato | B60K 6/48 |
| 9,587,613 | B2 * | 3/2017 | Cho | F02N 11/04 |
| 2001/0022245 | A1 * | 9/2001 | Rogg | B60K 6/365 180/65.21 |

(Continued)

FOREIGN PATENT DOCUMENTS

| | | | |
|---|---|---|---|
| JP | 4421567 | B2 | 2/2010 |
| JP | 2016-098748 | A | 5/2016 |

*Primary Examiner* — John Kwon
*Assistant Examiner* — Johnny H Hoang
(74) *Attorney, Agent, or Firm* — Oliff PLC

(57) ABSTRACT

In an engine starting system, a first controller activates, in response to a driver's starting request, a first starting device to rotate the rotating shaft of an engine. A second controller is communicably connected to the first controller. The second controller recognizes rotation of the rotor of a second starting device resulting from an activation of the first starting device. The second controller starts a power running operation of the second starting device based on the recognition of the rotation of the rotor. The first controller determines whether the power running operation of the second starting device has been started. The first controller deactivates, when it is determined that the power running operation has been started, the first starting device before a rotational angular position of the rotating shaft of the engine arrives at a compression top dead center of the engine.

12 Claims, 9 Drawing Sheets

(56) References Cited

U.S. PATENT DOCUMENTS

| | | | | |
|---|---|---|---|---|
| 2011/0172901 | A1* | 7/2011 | Okumoto | F02N 11/0818<br>701/113 |
| 2012/0239237 | A1* | 9/2012 | Hashimoto | B60K 6/365<br>701/22 |

* cited by examiner

SYSTEM FOR CONTROLLING STARTING OF ENGINE

CROSS REFERENCE TO RELATED APPLICATIONS

This application is based on and claims the benefit of priority from Japanese Patent Application 2016-096304 filed on May 12, 2016, the disclosure of which is incorporated in its entirety herein by reference.

TECHNICAL FIELD

The present disclosure relates to systems for controlling starting of an engine, i.e. an internal combustion engine.

BACKGROUND

Integrated starter generator (ISG) systems are widely used to apply torque to the rotating shaft of an engine at the startup of the engine.

An ISG system includes a motor-generator coupled to the rotating shaft of an engine via a belt, and causes the motor-generator as a starter to apply torque to the rotating shaft of the engine via the belt, thus starting, i.e. cranking, the engine. The ISG system also includes a starter, in addition to the motor-generator, for applying torque to the rotating shaft of the engine while the pinon of the starter is engaged with the ring gear of the rotating shaft of the engine at low temperatures. This is because the belt may be difficult to move at the low temperatures, which may result in difficulty of smoothly applying torque to the rotating shaft of the engine via the belt.

The larger torque applied to the belt, the higher strength and endurance of the belt need be. The larger toque applied to the belt may result in a belt tensioner being provided for absorbing torque fluctuations.

In particular, Japanese Patent Publication No. 4421567, referred to as a published patent document, discloses such an ISG system, which includes both a starter and a motor-generator. The ISG system disclosed in the published patent document includes an electronic control system (ECU) that is programmed to cause the starter to apply a first torque to the rotating shaft of an engine until the occurrence of first firing in the engine. Thereafter, the ECU of the ISG system is programmed to cause the motor-generator to apply a second torque, which is lower than the first torque, to the rotating shaft of the engine until the engine is fired up, enabling the rotating shaft to be rotated by combustion operations of the engine itself. This enables the motor-generator to have relatively lower maximum output required to start the engine, thus reducing manufacturing cost of the ISG system.

SUMMARY

Such an ISG system uses both a first starter, which is gear-connected to an engine, and a second starter, i.e. a motor-generator, which is belt-connected to the engine for cranking the engine.

The ISG system may therefore cause noise to be generated when the pinion of the first starter is engaged with the ring gear of the rotating shaft of the engine.

In addition, let us consider a case where the first starter applies first torque to the rotating shaft of an engine, and thereafter, the motor-generator, i.e. the second starter, starts to operate in the power running mode to apply second torque to the rotating shaft of the engine.

This may result in an overlap period between the period, which will be referred to as a starter driving period, in which the first starter is driving and the period, which will be referred to as a power running period, in which the motor-generator is operating in the power running mode. An overlong overlap period between the starter driving period and the power running period may result in the fuel consumption of the engine deteriorating, because of redundant activation of the starter. In contrast, an excessively short overlap period between the starter driving period and the power running period may also result in the fuel consumption of the engine deteriorating, because of an increase of the output torque of the motor-generator.

In view of the circumstances set forth above, one aspect of the present disclosure seeks to provide systems for controlling starting of an engine, each of which aims to solve these problems.

Specifically, an alternative aspect of the present disclosure aims to provide such control systems. Each of the control systems is configured to efficiently start an engine using both a first starting device that is gear-connected to a rotating shaft of an internal combustion engine and a second starting device that is belt-connected to the rotating shaft of the internal combustion engine while maintaining the fuel economy of the engine at a higher level.

The following describes solutions to the problems, and advantageous effects achieved by the solutions.

According to a first exemplary aspect of the present disclosure, there is provided an engine starting system. The engine starting system is configured to control a first starting device gear-connected to a rotating shaft of an internal combustion engine of a vehicle, and a second starting device including a rotor belt-connected to the rotating shaft of the internal combustion engine. Rotation of the rotating shaft of the internal combustion engine reciprocates a piston in a cylinder to compress a mixture of air and fuel in the cylinder. The engine starting system includes a first controller configured to activate, in response to a driver's starting request, the first starting device to rotate the rotating shaft of the internal combustion engine. The engine starting system includes a second controller communicably connected to the first controller and configured to 1. Recognize rotation of the rotor of the second starting device resulting from an activation of the first starting device 2. Start a power running operation of the second starting device to rotate the rotor based on the recognition of the rotation of the rotor.

The first controller is configured to

1. Determine whether the power running operation of the second starting device has been started 2. Deactivate, when it is determined that the power running operation has been started, the first starting device before a rotational angular position of the rotating shaft of the internal combustion engine arrives at a compression top dead center of the internal combustion engine.

The first controller of the first exemplary aspect of the present disclosure activates, in response to a driver's starting request, the first starting device to rotate the rotating shaft of the internal combustion engine, referred to simply as an engine. Because the second starting device is belt-connected to the rotating shaft of the engine, the second controller recognizes rotation of the rotor of the second starting device resulting from the activation of the first starting device. Then, the second controller starts the power running operation of the second starting device based on the recognition of the rotation of the rotor. On the other hand, the first controller determines whether the power running operation of the second starting device has been started. Then, the first controller deactivates the first starting device, when it is determined that the power running operation has been started and before the rotational angular position of the rotating shaft of the internal combustion engine arrives at the compression top dead center of the internal combustion engine.

That is, the first starting device, which is gear-connected to the rotating shaft of the engine, may generate noise, i.e. gear noise, due to engagement of the gear connection between the first starting device and the rotating shaft of the engine. In particular, such gear noise might become greater when the rotational angular position of the rotating shaft approaches a top dead center (TDC) of the cylinder due to compression reaction force in the cylinder. On the other hand, it is necessary to start the power running operation of the second starting device until the first starting device is turned off in order to sufficiently ensure the startability of the engine.

From these viewpoints, the first exemplary aspect of the present disclosure deactivates the first starting device, when determining that the power running operation of the second starting device has been started and before the rotational angular position of the rotating shaft 13 arrives at the compression TDC. This enables both reduction in gear noise and sufficient ensuring of the startability of the engine to be achieved. The first exemplary aspect of the present disclosure enables the first controller to recognize starting of the power running operation of the second starting device to thereby deactivate the first starting device. This enables the first starting device to be reliably deactivated at a desired timing while ensuring a proper overlap period between the activating period of the first starting device and the power running period of the second starting device. This results in efficient starting of the engine using both the first and second starting devices.

According to a second exemplary aspect of the present disclosure, the second controller is configured to send, to the first controller, a status signal after the rotation of the rotor of the second starting device resulting from the activation of the first starting device has been recognized. The status signal represents at least one of the rotation of the rotor of the second starting device, and start of the power running operation of the second starting device.

The first controller is configured to receive the status signal, and determine whether the power running operation of the second starting device has been started based on the received status signal.

After the rotation of the rotor of the second starting device resulting from the activation of the first starting device has been recognized, the second controller sends, to the first controller, the status signal. The status signal represents at least one of the rotation of the rotor of the second starting device, and start of the power running operation of the second starting device. This results in the first controller determining whether the power running operation of the second starting device has been started based on the status signal. This enables the first controller to reliably recognize whether the power running operation of the second starting device has been started.

According to a third exemplary aspect of the present disclosure, the second starting device includes a plurality of coils that rotate the rotor when energized. The second controller is configured to send, to the first controller, at least one of a rotation recognition signal, a phase recognition signal, and a power-running operation start signal as the status signal after the rotation of the rotor of the second starting device resulting from the activation of the first starting device has been recognized. The rotation recognition signal represents that the rotation of the rotor of the second starting device resulting from the activation of the first starting device has been recognized. The phase recognition signal represents a phase of one of the plurality of coils that should be energized. The power-running operation start signal represents that start of the power running operation of the second starter has been recognized. The first controller is configured to receive the at least one of the rotation recognition signal, phase recognition signal, and power-running operation start signal. Then, the first controller is configured to determine whether the power running operation of the second starting device has been started based on the at least one of the rotation recognition signal, phase recognition signal, and power-running operation start signal.

After the rotation of the rotor of the second starting device resulting from the activation of the first starting device has been recognized, the second controller is capable of sequentially recognizing the following predefined startup situations (1) Rotation of the rotor of the second starting device resulting from the activation of the first starting device has been recognized (2) The phase of one of the plurality of coils that should be energized (3) Start of the power running operation of the second starter having been recognized.

The second controller sends, to the first controller, one of the rotation recognition signal, the phase recognition signal, and the power-running operation start signal, which respectively represent the situations (1), (2), and (3), as the status signal. This enables the first controller to determine whether the power running operation of the second starting device has been started based on the at least one of the rotation recognition signal, phase recognition signal, and power-running operation start signal.

That is, at least one of the rotation recognition signal, phase recognition signal, and power-running operation start signal sent to the first controller from the second controller enables the first controller to know how the second starting device is driven. This contributes to suitably determining the deactivation timing of the first starting device.

According to a fourth exemplary aspect of the present disclosure, the first controller is configured to determine whether a predetermined delay time has elapsed since receiving of the at least one of the rotation recognition signal, phase recognition signal, and power-running operation start signal. The first controller is also configured to deactivate the first starting device upon determining that the predetermined delay time has elapsed since receiving of the at least one of the rotation recognition signal, phase recognition signal, and power-running operation start signal.

Communications between the first controller and the second controller may result in communication delay therebetween. Because the first controller has larger processing load during an early stage of startup of the engine, the earlier the stage of startup of the engine is, the longer the communication delay between the first controller and the second controller is.

From this viewpoint, the first controller waits until the predetermined delay time has elapsed since receiving of the at least one of the rotation recognition signal, phase recognition signal, and power-running operation start signal. After waiting, the first controller deactivates the first starting device. This enables the deactivation timing of the first starting device to be determined depending on the communication delay. That is, adjusting the delay time depending on the communication delay enables the deactivation timing of the first starting device to be properly determined.

Preferably, the first controller delays, relative to the receiving timing of the rotation recognition signal or the phase recognition signal, the deactivation timing of the first starting device to a desired timing located before arrival of the rotational angular position of the rotating shaft at the compression TDC. Because the second controller sequentially recognizes the predetermined startup situations (1), (2), and (3) as described previously, recognizing the first situation (1) or the second situation (2) enables the power running operation of the second stating device to be recognized sequentially from the first situation (1) or the second situation (2). This enables the deactivation timing of the first starting device to be determined relative to the recognizing timing of the first situation (1) or the second situation (2). This makes it possible to determine deactivation of the first starting device earlier, thus further reducing adverse effects due to the communication delay.

According to a fifth exemplary aspect of the present disclosure, the first and second starting devices are connected to a power source installed in the vehicle. The first and second devices are configured to receive power supplied from the power source. The first controller is configured to monitor how a state change parameter has been changed since the activation of the first starting device. The state change parameter includes at least one of an amount of discharge from the power source, and an amount of power supply to the first staring device. The first controller is configured to determine whether the power running operation of the second starting device has been started based on how the state change parameter has changed since the activation of the first starting device.

When the power running operation of the second starting device has been started in addition to the operation of the first starting device, the amount of discharge from the power source is changed or the amount of power supply to the first staring device is changed. The first controller uses this change of the amount of discharge from the power source or the amount of power supply to the first staring device to determine whether the power running operation of the second starting device has been started without using information from the second controller.

According to a sixth exemplary aspect of the present disclosure, the second controller includes a control circuit, and a driver including a plurality of switching elements. The control circuit is configured to control on-off switching operations of the switching elements of the driver to control a rotational speed of the rotor of the second starting device. The first controller is configured to monitor how a temperature of at least one of the switching elements has increased since the activation of the first starting device. Then, the first controller is configured to determine whether the power running operation of the second starting device has been started based on how the temperature of the at least one of the switching elements has increased since the activation of the first starting device.

The on-off switching operations of the switching elements of the driver carried out when the power running operation of the second starting device increases the temperature of at least one of the switching elements. The first controller uses this temperature increase to determine whether the power running operation of the second starting device has been started without using information from the second controller.

According to a seventh exemplary aspect of the present disclosure, the first controller is configured to monitor a flow rate of intake air into the cylinder of the engine has increased since the activation of the first starting device. The first controller is configured to determine whether the power running operation of the second starting device has been started based on how the flow rate of intake air into the cylinder of the engine has increased since the activation of the first starting device.

The rotational speed of the rotating shaft of the engine, referred to as an engine rotational speed, increases when the power running operation of the second starting device has been started, so that the flow rate of intake air into the cylinder of the engine increases. The first controller uses this flow-rate increase of intake air to determine whether the power running operation of the second starting device has been started without using information from the second controller.

According to an eighth exemplary aspect of the present disclosure, the first controller is configured to set, after determining that the power running operation of the second starting device has been started, a timing to deactivate the first starting device to be before a maximum compression-pressure timing at which a compression pressure in the cylinder is maximized.

When the rotational angular position of the rotating shaft is located at a position where the pressure in the cylinder is maximized, transfer torque through the engagement of the gear connection between the first starting device and the rotating shaft of the engine is maximized. From this viewpoint, the configuration of the first controller according to the eighth exemplary aspect sets the timing to deactivate the first starting device to be before the maximum compression-pressure timing at which the compression pressure in the cylinder is maximized. This therefore results in less gear noise.

According to a ninth exemplary aspect of the present disclosure, the first controller is configured to control, after determining that the power running operation of the second starting device has been started, a fuel injection system installed in the engine to start injection of fuel into the cylinder of the engine before the engine rotational speed is within a predetermined resonance engine rotational speed range. The resonance engine rotational speed range corresponds to a predetermined resonance frequency range of the engine.

The engine has the predetermined resonance frequency range corresponding to the predetermined resonance engine rotational speed range that is usually lower than a predetermined idle speed. To avoid vibrations of the engine during an increase of the engine rotational speed, it is desired to cause the engine rotational speed to pass through the resonance engine rotational speed range as soon as possible.

From this viewpoint, the configuration of the first controller according to the ninth exemplary aspect of the present disclosure controls the fuel injection system to start injection of fuel into the cylinder of the engine before the engine rotational speed is within the resonance engine rotational speed range. This enables both the combustion torque based on combustion of the fuel and torque applied from the second starting device to the rotating shaft to increase the engine rotational speed. This enables the engine rotational speed to pass through the resonance engine rotational speed range in a shorter time, resulting in less engine vibration.

This configuration, which starts the fuel injection into the cylinder of the engine after start of the power running operation of the second starting device, enables the fuel economy of the engine to be improved.

According to a tenth exemplary aspect of the present disclosure, the first controller is configured to (1) Determine, after it is determined that the power running operation of the second starting device has been started, whether a rate of increase of the engine rotational speed is lower than a predetermined threshold rate (2) Control the fuel injection system to start injection of fuel into the cylinder of the engine before the engine rotational speed is within the predetermined resonance engine rotational speed range upon determining that the rate of increase of the engine rotational speed is lower than the predetermined threshold rate (3) Control the fuel injection system to start injection of fuel into the cylinder of the engine after the engine rotational speed is within the predetermined resonance engine rotational speed range upon determining that the rate of increase of the engine rotational speed is equal to or higher than the predetermined threshold rate.

The rate of increase of the engine rotational speed after start of the power running operation of the second starting device may change depending on various factors. For example, the rate of increase of the engine rotational speed after start of the power running operation of the second starting device may be low if there is one of (1) The state of charge (SOC) of the power source is low (2) The engine is in a low-temperature condition (3) The second controller performs a current limitation task to limit the flow of a current therethrough depending on the temperature thereof.

From this viewpoint, the first controller controls the fuel injection system to start injection of fuel into the cylinder of the engine before the engine rotational speed is within the predetermined resonance engine rotational speed range upon determining that the rate of increase of the engine rotational speed is lower than the predetermined threshold rate.

This enables the rotational angular position of the rotating shaft of the engine to rapidly pass through the predetermined resonance engine rotational speed range.

Additionally, the first controller controls the fuel injection system to start injection of fuel into the cylinder of the engine after the engine rotational speed is within the predetermined resonance engine rotational speed range upon determining that the rate of increase of the engine rotational speed is equal to or higher than the predetermined threshold rate.

This enables the fuel economy of the engine to be improved.

According to an eleventh exemplary aspect of the present disclosure, the first controller is connected to an intake-air quantity control mechanism installed in the internal combustion engine. The intake-air quantity control mechanism is configured to control a quantity of intake air into the cylinder of the internal combustion engine. The first controller is configured to control the intake-air quantity control mechanism to perform limitation of the quantity of intake air into the cylinder of the engine to a predetermined limited quantity before determining that the power running operation of the second starting device has been started.

The higher the compression reaction force in the cylinder is, the greater the gear noise due to the gear engagement between the first starting device and the rotating shaft of the engine when the engine is cranked by the first starting device. From this viewpoint, the first controller controls the intake-air quantity control mechanism to perform limitation of the quantity of intake air into the cylinder of the engine to the predetermined limited quantity before determining that the power running operation of the second starting device has been started. This reduces the compression reaction force in the cylinder, resulting in less gear noise. Even if cranking of the rotating shaft of the engine by the first starting device is continuously performed due to delay of start of the power running operation of the second starting device, the first controller results in less gear noise.

According to a twelfth exemplary aspect of the present disclosure, the first controller is configured to control the intake-air quantity control mechanism to remove the limitation of the quantity of intake air into the cylinder of the internal combustion engine after determining that the power running operation of the second starting device has been started.

This configuration prevents adverse effects on combustion of the fuel in the cylinder after the power running operation of the alternator, thus improving the startability of the engine.

BRIEF DESCRIPTION OF THE DRAWINGS

Other aspects of the present disclosure will become apparent from the following description of embodiments with reference to the accompanying drawings in which.

DETAILED DESCRIPTION OF EMBODIMENT

Figure 1:
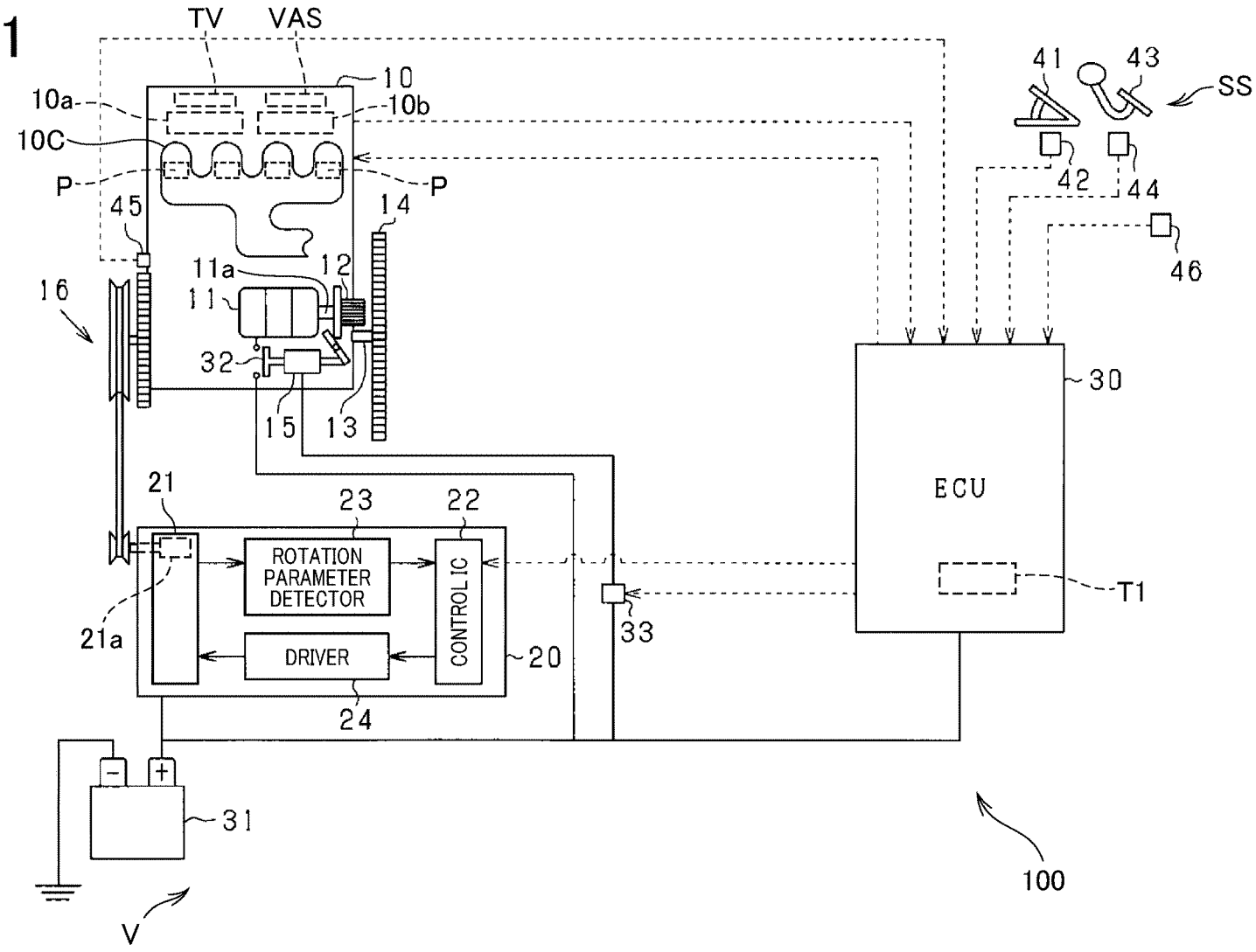
FIG. 1 is a circuit diagram schematically illustrating an overall structure of an engine starting system according to the first embodiment of the present disclosure.

The following describes embodiments of the present disclosure with reference to the accompanying drawings. In the embodiments, like parts between the embodiments, to which like reference characters are assigned, are omitted or simplified to avoid redundant description.

First Embodiment

The following describes the first embodiment of the present disclosure. An engine starting system 100 according to the first embodiment is installed in a vehicle V that is equipped with a known four-cycle internal combustion engine, i.e. an engine 10.

Specifically, the engine 10, which is designed as a multicylinder engine, includes a rotating shaft, such as a crankshaft, 13 having opposing first and second ends. The engine 10 is operative to compress the mixture of intake air and fuel or intake air by a piston P within the combustion chamber of each cylinder 10C and burn the compressed air-fuel mixture or the mixture of the compressed air and fuel within the combustion chamber of each cylinder 10C. This reciprocates the piston P in each cylinder 10C through a top dead center (TDC) of the cylinder 10C to thereby rotate the rotating shaft 13 in a forward direction. This changes the fuel energy to rotational energy of the crankshaft 13, thus generating torque of the rotating shaft 13 based on the mechanical energy.

Note that the amount of intake air taken into each cylinder 10C of the engine 10 is controlled by an intake valve provided for the corresponding cylinder 10C.

In addition, the forward direction of rotation of the rotating shaft 13 represents the rotational direction of the rotating shaft 13 when the vehicle V goes forward.

Referring to FIG. 1, the engine 10 includes a fuel injection system 10*a* and an ignition system 10*b*.

The fuel injection system 10*a* includes actuators, such as fuel injectors and igniters provided for the respective cylinders 10C. The fuel injection system 10*a* causes the fuel injector to spray fuel either directly into each cylinder 10C of the engine 10 or into an intake manifold (or intake port) just ahead of each cylinder 10C thereof to thereby burn the air-fuel mixture in each cylinder 10C of the engine 10.

The ignition system 10*b* includes actuators, such as igniters, and causes the actuators to provide an electric current or spark to ignite an air-fuel mixture in each cylinder 10C of the engine 10, thus burning the air-fuel mixture.

The engine 10 includes a starter 11 as an example of rotary electric machines. The starter 11, which serves as, for example, a first starting device, has a rotating shaft 11*a* having opposing first and second ends. The starter 11 includes a drive unit coupled to the first end of the rotating shaft 11*a*. The drive unit of the starter 11 is capable of turning the rotating shaft 11*a*.

The starter 11 also includes a solenoid mechanism 15 including a solenoid; the solenoid mechanism 15 reciprocably shifts the rotating shaft 11*a* in its axial direction. To the second end of the rotating shaft 11*a*, a pinion 12 is mounted. To the first end of the rotating shaft 13, a ring gear 14 is mounted.

The engine starting system 100 includes a battery 31, which is an example of a direct-current (DC) power source, electrically connected to the starter 11 via a switch 32, and electrically connected to the solenoid of the solenoid mechanism 15 via a relay 33. The starter 11 is arranged to face the ring gear 14 such that the shifting operation of the rotating shaft 11*a* to the ring gear 14 by the solenoid mechanism 15 enables the pinon 12 to be engaged with the ring gear 14. This engagement of the pinion 12 with the ring gear 14 enables torque, i.e. positive torque, of the starter 11 to be transferred to the rotating shaft 13 of the engine 10.

The engine starting system 100 includes a motor-generator apparatus 20 as an example of rotary electric machines. The engine 10 includes a power transfer mechanism 16 comprised of, for example, a pulley and a belt. The power transfer mechanism 16 is operative to transfer torque, i.e. rotary power, of the rotating shaft 13 of the engine 10 to the motor-generator apparatus 20.

The motor-generator apparatus 20 serves as an alternator, i.e. a power generator, that converts the torque of the rotating shaft 13 of the engine 10 transferred from the engine 10 into electrical power. The motor-generator apparatus 20 also serves as a motor that supplies rotating power, i.e. torque, to the rotating shaft 13 of the engine 10 via the power transfer mechanism 16.

In particular, the starter 11 is designed as a starting device that can be externally turned on or off, and designed as a low revolution per minute (RPM) motor capable of generating relatively high torque in a low RPM range. The motor-generator apparatus 20 is designed as a starting device operating in a motor mode, i.e. a power running mode, and designed as a high RPM motor capable of rotating at a higher RPM range.

The motor-generator apparatus 20 includes an alternator, i.e. a motor-generator, 21, a control integrated circuit (IC) 22, a rotation parameter detector 23, and a driver 24.

The alternator 21 is designed as, for example, a three-phase alternating-current (AC) rotary electric machine comprised of, for example, a stator, a rotor 21*a*, a rotor coil, and the like. The stator includes, for example, a stator core and three-phase stator coils. The rotor 21*a* is coupled to an output shaft to which the power transfer mechanism 16 is coupled, is configured to be rotatable relative to the stator core together with the output shaft. The three-phase stator coils are wound in, for example, slots of the stator core and around the stator core. The rotor coil is wound around the rotor 21*a* and is operative to generate a magnetic field in the rotor 21*a* when energized.

That is, the alternator 21 is capable of operating in the motor mode, i.e. the power running mode, to rotate the rotor 21*a* based on magnetic interactions between the magnetic field generated in the rotor 21*a* and a rotating magnetic field generated by the three-phase stator coils. This enables the rotating shaft 13 of the engine 10 to rotate via the power transfer mechanism 16. In other words, the alternator 21 supplies torque to the rotating shaft 13 of the engine 10 via the power transfer mechanism 16, thus rotating the rotating shaft 13 of the engine 10.

In addition, the alternator 21 is capable of operating in a generator mode to generate electrical power in the stator coils based on electromotive force induced by rotation of the rotor 21*a*; the rotation of the rotor 21*a* is based on rotation of the rotating shaft 13 of the engine 10 via the power transfer mechanism 16.

For example, the starter 11 is activated, i.e. turned on based on a starter drive command with a high level, i.e. an on level. The starter 11 is also deactivated, i.e. turned off, based on the starter drive command with a low level, i.e. an off level. The alternator 21 is activated to operate in the power running mode to apply torque to the rotating shaft 13 of the engine 10 while changing the rotational speed of the rotor 21*a*.

The driver 24 includes a known inverter circuit including a plurality of switching elements, such as MOSFETs, which are mounted to, for example, an inverter board; these switching elements are connected in, for example bridge configuration. The driver 24 is connected between the alternator 21 and a the battery 31.

The driver 24 has a first function of converting DC power supplied from the battery 31 into alternating-current (AC) power, thus applying the AC power to the three-phase stator coils.

The driver 24 also has a second function of converting AC power supplied from the alternator 21 into DC power, and supplying the DC power to the battery 21.

The rotation parameter detector 23 is operative to measure at least one parameter associated with rotation of the rotor 21*a* of the alternator 21.

Specifically, the rotation parameter detector 23 is operative to measure currents, i.e. three-phase currents, flowing through the respective three-phase stator coils when the alternator 21 is operating as the motor, and output the three-phase currents to the control IC 22. The rotation parameter detector 23 is also operative to measure the electromotive force induced in the alternator 21 when the alternator 21 is operating as the power generator, and output the induced electromotive force to the control IC 22.

The control IC 22, which is comprised of, for example, a microcomputer and a memory unit, serves as a controller for controlling the alternator 21.

Specifically, when operating the alternator 21 in the motor mode, the control IC 22 controls the driver 24 to convert the DC power supplied from the battery 31 into three-phase AC power, thus applying the three-phase AC power to the three-phase stator coils of the alternator 21. This enables the three-phase stator coils to generate the rotating magnetic field set forth above, thus rotating the rotor 21*a*. In particular, the control IC 22 controls, based on the three-phase currents measured by the rotation parameter detector 23, on-off switching operations of the switching elements of the driver 24 such that the rotational speed of the rotor 21*a* follows a predetermined target rotational speed.

In addition, when operating the alternator 21 in the generator mode, the control IC 22 obtains the induced electromotive force measured by the rotation parameter detector 23. This enables the control IC 22 to obtain information indicative of the rotation of the rotor 21*a*, i.e. the rotational speed of the rotor 21*a*, because the frequency of the induced electromotive force depends on the rotational speed, i.e. the number of rotations of the rotor 21*a* per unit time, of the alternator 21.

That is, the motor-generator apparatus 20 is designed as a sensor-less motor-generator with no rotation sensors for directly measuring the rotational speed of the rotor 21*a*.

Specifically, the rotation parameter detector 23 is capable of measuring a voltage or a current induced in the alternator 21 while the rotor 21*a* of the alternator 21 is rotating. That is, the rotation parameter detector 23 is capable of measuring the rotational angle of the rotor 21*a*, i.e. the alternator 21, relative to a predetermined position based on the measured induced voltage or induced current.

The control IC 22 is therefore capable of (1) Determining whether the alternator 21 is operating based on the induced voltage or induced current detected by the rotation parameter detector 23

(2) Identifying the phase of one of the three-phase coils which the driver 14 should energize, i.e. should supply an AC current to, based on the induced voltage or induced current detected by the rotation parameter detector 23.

That is, the control IC 22 controls, based on the phase of the three-phase coils which the driver 14 should energize, on-off switching operations of the switching elements of the driver 24, thus energizing one of the three-phase coils having the determined phase.

Additionally, the rotation parameter detector 23 or the control IC 22 is capable of calculating the rotational speed Ne of the rotating shaft 13 of the engine 10 based on the rotational speed of the rotor 21*a*, i.e. the alternator 21, and a predetermined speed reduction ratio of the power transfer mechanism 16. The rotational speed Ne of the rotating shaft 13 of the engine 10 will be referred to simply as an engine rotational speed NE hereinafter. Note that the rotational speed of the alternator 21 is higher by the speed reduction ratio of the power transfer mechanism 16 than the rotational speed Ne of the rotating shaft 13.

The rotating shaft 13 of the engine 10 is coupled to a driving axle having at both ends driving wheels via a clutch and a gear mechanism, such as a transmission. Because these components of the driving axle, driving wheels, clutch and gear mechanism of the vehicle V are well known components, the specific descriptions of these components are omitted.

The engine starting system 100 also includes an electronic control unit (ECU) 30, which serves as, for example, a main controller, for performing overall control of the engine starting system 100. The ECU 30 is a well-known electronic control unit comprised of a microcomputer and a memory unit. The ECU 30 is operative to control the engine 10 based on measurement values measured by various sensors SS installed in the vehicle V.

The ECU 30 is electrically connected to the battery 31, and operates based on DC power supplied from the battery 31. The battery 31 is also electrically connected to the starter 11 via a switch 32, and is electrically connected to the solenoid of the solenoid mechanism 15 via a relay 33. The relay 33 is controllably connected to the ECU 30. That is, the ECU 30 controls the relay 33 to open or close the relay 33. The switch 32 is linked to the pinion 12 such that the shifting operation of the pinion 12 to or from the ring gear 14 enables the solenoid mechanism 15 to turn on or off the switch 32.

Specifically, the ECU 30 turns on the relay 33 to thereby energize the solenoid of the solenoid mechanism 15 based on the DC power supplied from the battery 31. This causes the solenoid mechanism 15 to shift the pinion 12 from a predetermined initial position to the ring gear 14 so that the pinion 12 is engaged with the ring gear 14. The shifting operation of the pinion 12 to the ring gear 14 causes the switch 32 to be turned on, resulting in the starter 11 being activated based on the DC power supplied from the battery 31. Because the pinion 12 is meshed with the ring gear 14, the starter 11 starts turning the rotating shaft 13 of the engine 10, thus starting cranking of the engine 10.

For example, when the rotational speed of the rotating shaft 13 has reached a predetermined rotational speed, the ECU 30 turns off the relay 33 to thereby deenergize the solenoid of the solenoid mechanism 15. This interrupts the DC power supply from the battery 31 to the solenoid of the solenoid mechanism 16, causing the solenoid mechanism 16 to shift the pinion 12 away from the ring gear 14 to the predetermined initial position. This results in the pinion 12 being disengaged from the ring gear 14.

The shifting operation of the pinion 12 away from the ring gear 14 to the predetermined initial position causes the switch 32 to be turned off, resulting in the starter 11 being deactivated.

The ECU 30 is also communicably coupled to the control IC 22. The ECU 30 serves as, for example, a first controller and the control IC 22 serves as, for example, a second controller.

In addition, the engine starting system 100 includes various sensors SS including, for example, an accelerator sensor 42, a brake sensor 44, a rotational speed sensor 45, and a vehicle speed sensor 46.

The accelerator sensor 42 is operative to repeatedly measure the actual position or stroke of an accelerator pedal, which is an example of accelerator operating members, 41 operable by a driver of the vehicle V, and repeatedly output, to the ECU 30, a measurement signal indicative of the measured actual stroke or position of the accelerator pedal 41. The accelerator pedal is linked to a throttle valve system TV including a throttle valve mounted in, for example, the intake manifold. That is, the throttle valve system TV is configured to change an angular position of the throttle valve to control the quantity of intake air into the engine 10 according to the actual position or stroke of the accelerator pedal operated by a driver.

The brake sensor 44 is operative to repeatedly measure the actual position or stroke of a brake pedal 43 operable by a driver of the vehicle V, and repeatedly output, to the ECU 30, a measurement signal indicative of the measured actual stroke or position of the brake pedal 43.

The rotational speed sensor 45 is operative to repeatedly measure the rotational speed of the rotating shaft 13 of the engine 10, and repeatedly output, to the ECU 30, a measurement signal indicative of the measured rotational speed of the rotating shaft 13 of the engine 10. The rotational speed sensor 45 is also operative to repeatedly measure the rotational angular position of the rotating shaft 13 of the engine 10 relative to the closest, i.e. next, compression TDC of the corresponding cylinder 10C. Then, the rotational speed sensor 45 is operative to repeatedly output, to the ECU 30, a measurement signal indicative of the measured rotational angular position of the rotating shaft 13 relative to the next compression TDC.

The vehicle speed sensor 46 is operative to repeatedly measure the travelling speed of the vehicle V as a vehicle speed, and repeatedly output, to the ECU 30, a measurement signal indicative of the measured vehicle speed.

The ECU 30 is designed as, for example, a typical microcomputer circuit comprised of, for example, a CPU, a storage medium including a ROM and a RAM, and an input/output (I/O).

The ECU 30 receives the measurement signals output from the sensors SS, and determines the operating conditions of the engine 10. Then, the ECU 30 performs, in accordance with one or more control programs, i.e. routines, stored in the storage medium, various tasks for controlling the engine 10 using (1) The determined operating conditions of the engine 10

(2) Various pieces of data stored in the storage medium.

For example, the various tasks include a combustion task T1 (see FIG. 1) including a fuel injection control task and an ignition timing control task.

The fuel injection control task is designed to adjust the fuel injection timing for each cylinder 10C to a proper timing, and controls the fuel injection system 10*a* to adjust the injection quantity for the fuel injector for each cylinder 10C to a suitable quantity. Then, the fuel injection control task is designed to cause the fuel injection system 10*a* to spray the suitable injection quantity of fuel into a sequentially selected cylinder or the intake manifold of the engine 10 at the proper fuel injection timing.

The ignition timing control task is designed to control the ignition system 10*b* to adjust the ignition timing of each igniter for igniting the compressed air-fuel mixture or the mixture of the compressed air and fuel in a corresponding one of the cylinders 10C at proper timing. The ignition timing for each cylinder 10C is represented as, for example, a crank angle of the rotating shaft 13 for the corresponding cylinder 10C with respect to the top dead center (TDC) of the corresponding cylinder 10C.

In addition, the various tasks include an idle reduction control task. The idle reduction control task is configured to control the fuel injection system 10*a* when a predetermined automatic stop condition is satisfied, thus preventing the fuel injection system 10*a* from spraying fuel from the respective injectors into the corresponding cylinders 10C or the intake manifold of the engine 10. This results in the engine 10 being in an idle reduction state, resulting in the vehicle V coasting.

The idle reduction control task is also configured to automatically restart the engine 10 when an engine restart condition is satisfied while the engine 10 being in the idle reduction state.

For example, the automatic stop condition includes, for example, the driver's operated stroke of the accelerator pedal 41 is zero, i.e. a driver of the vehicle V completely releases the accelerator pedal 41, the brake pedal 43 is depressed by the driver, and the vehicle speed is equal to or lower than a preset speed.

For example, the engine restart condition includes, for example, the accelerator pedal 41 is depressed by the driver or the driver's operated stroke of the brake pedal 43 is zero, i.e. the driver completely releases the brake pedal 43. These driver's operations are called driver's engine restart requests.

Note that an initial engine start condition is that a starter switch is turned on in response to, for example, the driver's operation of an ignition key to a starter-on position. This driver's operation is called a driver's engine start request.

The engine restart condition and the initial engine start condition constitute engine start conditions.

The engine starting system 100 is configured to initially start the engine 10 or automatically restart the engine 10 based on the combination of the starter 11 and the alternator 21. In particular, the engine starting system 100 is configured to (1) Activate, i.e. turn on, the starter 11 to crank the engine 10 in an early state of starting of the engine 10

(2) Start, thereafter, to operate the alternator 21 in the power running mode to crank the engine 10 while deactivating the starter 11

(3) Deactivate, i.e. turn off, the starter 11 when the alternator 21 have started operating in the power running mode.

That is, the engine starting system 100 activates the starter 11 in response to the initial startup condition or the automatic restart condition being satisfied. This results in the rotor 21*a* of the alternator 21 rotating based on rotation of the rotating shaft 13 of the engine 10. At that time, the control IC 22 controls the driver 24 to cause the alternator 21 to operate in the power running mode when recognizing rotation of the rotor 21*a* of the alternator 21.

When determining that the alternator 21 is started to operate in the power running mode, the ECU 30 deactivate the starter 11 before the piston P of a cylinder 10C reaches the immediately next compression TDC.

Figure 2:
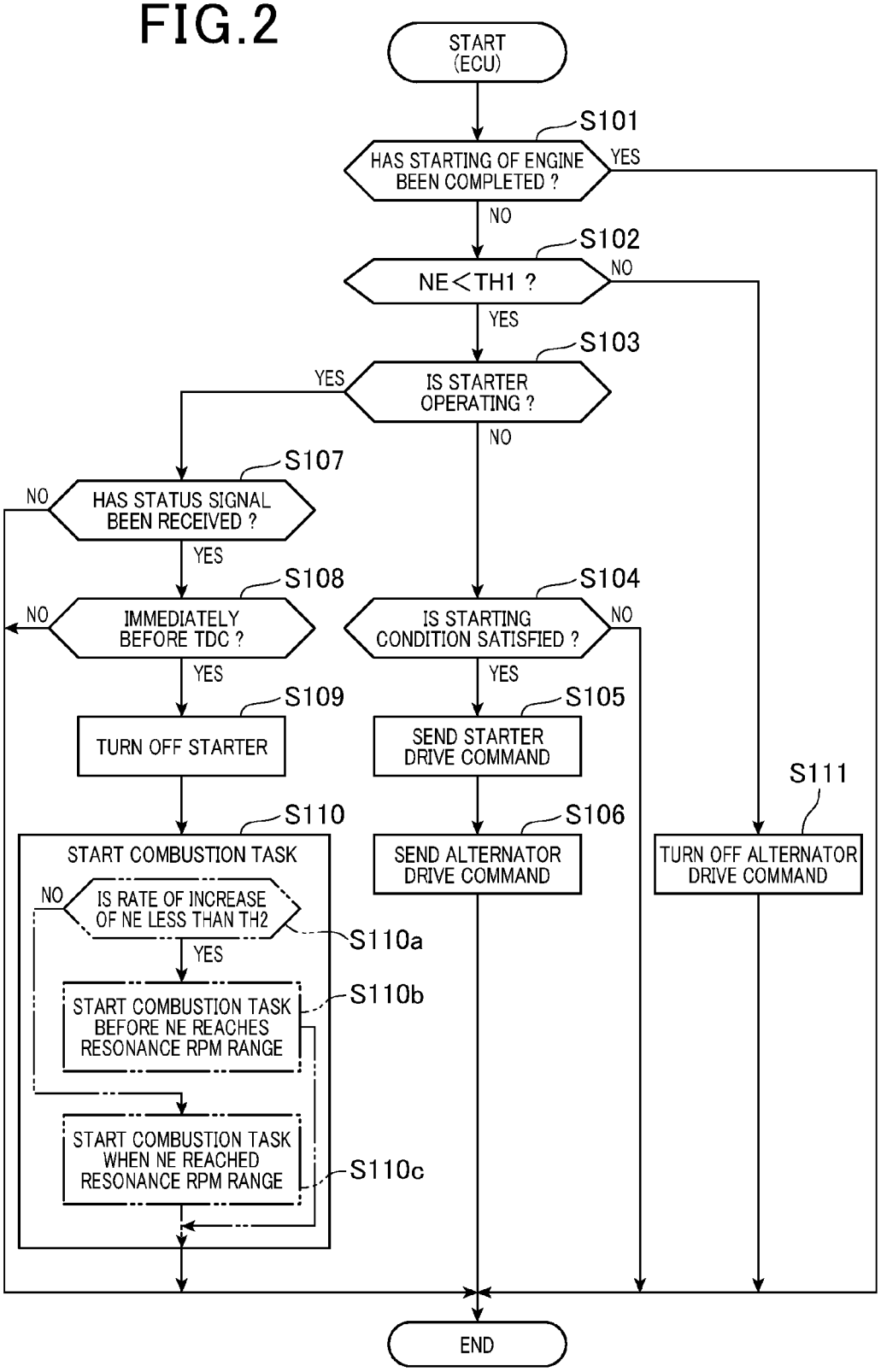
FIG. 2 is a flowchart schematically illustrating a first starting routine periodically carried out by an ECU illustrated in FIG. 1 according to the first embodiment.

The following describes a first engine starting routine repeatedly carried out by the ECU 30 in a predetermined first control period with reference to FIG. 2.

In step S101, the ECU 30 determines whether starting of the engine 10 has been completed, i.e. the engine 10 has been fired up, enabling the rotating shaft 13 to be rotated by combustion operations of the engine 10 itself. For example, when starting of the engine 10 has not been completed after automatic stop of the engine 10.

When it is determined that starting of the engine 10 has been completed (YES in step S101), the ECU 30 terminates the first starting routine. Otherwise, when it is determined that starting of the engine 10 has not been completed (NO in step S101), the first engine starting routine proceeds to step S102. In step S102, the ECU 30 deter mines whether the rotational speed Ne of the rotating shaft 13 of the engine 10, which will be referred to simply as an engine rotational speed NE hereinafter, is lower than a predetermined threshold TH1. The threshold TH1 is set to, for example, 500 RPM that determines whether to stop the alternator 10 from operating in the power running mode.

When it is determined that the engine rotational speed NE is lower than the predetermined threshold TH1 (YES in step S102), the first engine starting routine proceeds to step S103. Otherwise, when it is determined that the engine rotational speed NE is equal to or higher than the predetermined threshold TH1 (NO in step S102), the first engine starting routine proceeds to step S111.

In step S103, the ECU 30 determines whether the starter 11 is operating. Specifically, the ECU 30 determines whether it has generated a starter drive command. When it is determined that the starter 11 is not operating (NO in step S103), the ECU 30 determines whether one of the engine start conditions is satisfied in step S104.

For example, when the engine restart condition is satisfied after automatic stop of the engine 10, the ECU 30 performs affirmative determination in step S104, and the first engine starting routine proceeds to step S105. Otherwise, when the engine restart condition is not satisfied after automatic stop of the engine 10, the ECU 30 performs negative determination in step S104, and terminates the first engine starting routine.

In step S105, the ECU 30 generates the starter drive command, and sends the starter drive command to the relay 33, thus turning on the relay 33. This causes the solenoid mechanism 15 to shift the pinion 12 from the predetermined initial position to the ring gear 14 so that the pinion 12 is engaged with the ring gear 14. The shifting operation of the pinion 12 to the ring gear 14 causes the switch 32 to be turned on. This starts supply of DC power to the starter 11. When the starter 11 is activated based on the supplied DC power, rotational power of the starter 11 is transferred to the rotating shaft 13 of the engine 10.

Subsequently or simultaneously, the ECU 30 generates an alternator drive command, and sends the alternator drive command to the control IC 22, in other words, turns on the alternator drive command, in step S106. Thereafter, the ECU 30 terminates the first engine starting routine.

Otherwise, when it is determined that the starter 11 is operating (YES in step S103), the first engine starting routine proceeds to step S107. In step S107, the ECU 30 determines whether it has received a predetermined status signal from the control IC 22; the status signal represents at least one of (1) Rotation of the rotor 21*a* of the alternator 21

(2) Start of the power running operation of the alternator 21.

For example, a power-running mode start signal, i.e. a power-running operation start signal, is sent from the control IC 22 as the status signal according to the first embodiment. When having received the power-running mode start signal, the ECU 30 performs affirmative determination in step S107.

Then, the ECU 30 determines whether the rotational angular position of the rotating shaft 13 of the engine 10 is located within a predetermined high-pressure angular range, such as a range from BTDC 45 degrees to BTDC 5 degrees inclusive, immediately before the next compression TDC in step S108. Note that BTDC $\alpha$ degrees represents the rotational angular position of the rotating shaft 13 before the next combustion TDC by $\alpha$ degrees. The predetermined angular position of the rotating shaft 13 immediately before the next combustion TDC in a corresponding cylinder 10C represents a timing immediately before the maximum compression-pressure timing at which the compression pressure in the corresponding cylinder 10C is maximized.

When it is determined that the rotational angular position of the rotating shaft 13 of the engine 10 is located within the predetermined high-pressure angular range, the ECU 30 determines that the actual rotational angular position of the rotating shaft 13 of the engine 10 is located immediately before the next compression TDC. Then, the first engine starting routine proceeds to step S109.

Otherwise, when it is determined that the ECU 30 has not received the predetermined status signal from the control IC 22 or that the rotational angular position of the rotating shaft 13 is located outside of the predetermined high-pressure angular range (NO in step S107 or S108), the ECU 30 terminates the first engine starting routine while continuously activating the starter 11.

In step S109, the ECU 30 turns off the starter drive command, thus deactivating, i.e. turning off, the starter 11. Specifically, in step S109, the ECU 30 turns off the relay 33 to thereby deenergize the solenoid of the solenoid mechanism 15. This interrupts the DC power supply from the battery 31 to the solenoid of the solenoid mechanism 16, causing the solenoid mechanism 16 to shift the pinion 12 away from the ring gear 14 to the predetermined initial position. This results in the pinion 12 being disengaged from the ring gear 14. The shifting operation of the pinion 12 away from the ring gear 14 to the predetermined initial position causes the switch 32 to be turned off, resulting in the starter motor 11 being deactivated.

Following the operation in step S109, the ECU 30 starts the combustion task T1 including the fuel injection control task and ignition timing control task for each cylinder 10C after the present time in step S110. That is, the ECU 30 causes each fuel injector of the fuel injection system 10*a* to spray fuel either directly into the corresponding cylinder 10C or the intake manifold during the compression cycle of the corresponding cylinder 10C. This results in the air-fuel mixture in each cylinder 10C being combusted during the combustion cycle of the corresponding cylinder 10C. After completion of the operation in step S110, the ECU 30 terminates the first engine starting routine.

When the engine rotational speed NE has increased based on the action of the alternator 21, so that the determination in step S102 is affirmative. At that time, the first engine stating routine proceeds to step S111. In step S111, the ECU 30 turns off the alternator drive command, in other words, sends an alternator stop command to the control IC 22, thus causing the power running operation of the alternator 20 to be stopped. Thereafter, the ECU 30 terminates the first engine starting routine.

Figure 3:
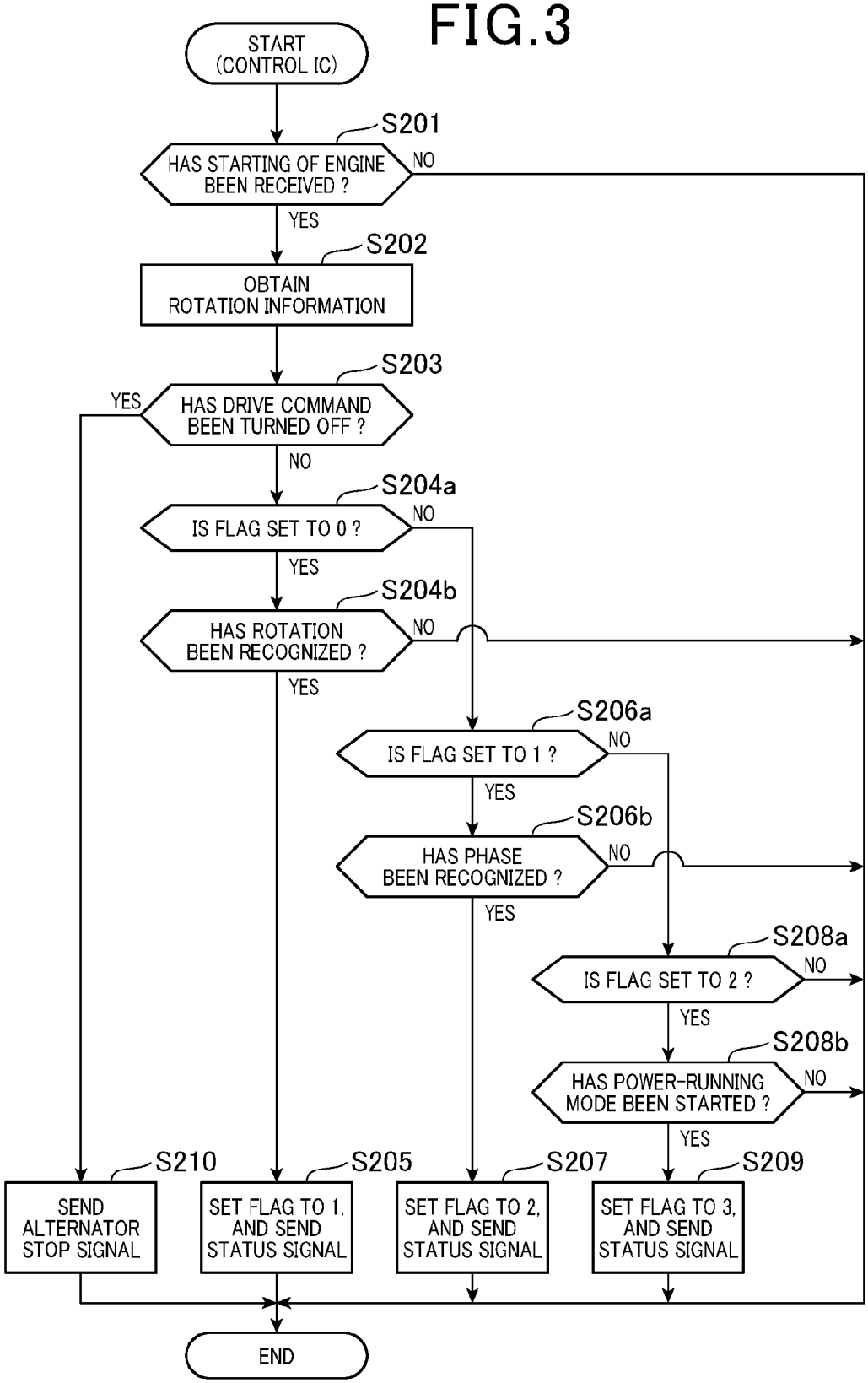
FIG. 3 is a flowchart schematically illustrating a second starting routine periodically carried out by a control IC illustrated in FIG. 1 according to the first embodiment.

The following describes a second engine starting routine repeatedly carried out by the control IC 22 in a predetermined second control period with reference to FIG. 3. The second control period can be set to be identical to or different from the first control period.

In step S201, the control IC 22 determines whether it has received the alternator drive command from the ECU 30 so that authorization of the power running operation of the alternator 21 has been obtained. When it is determined that authorization of the power running operation of the alternator 21 has not been obtained (NO in step S201), the control IC 22 does not cause the alternator 21 to operate in the power running mode, and terminates the second engine starting routine.

Otherwise, when it is determined that authorization of the power running operation of the alternator 21 has been obtained (YES in step S201), the control IC 22 obtains, from the rotation parameter detector 23, rotational information, i.e. a rotation parameter, indicative of rotation of the rotor 21*a* of the alternator 21 in step S202. Specifically, the rotation parameter detector 23 repeatedly measures the voltage or current induced in the alternator 21 while the rotor 21*a* of the alternator 21 is rotating, and the rotation parameter detector 23 repeatedly outputs the induced voltage or induced current to the control IC 22.

Then, in step S202, the control IC 22 obtains, as the rotation information, the induced voltages or induced currents successively sent from the rotation parameter detector 23.

Following the operation in step S202, the control IC 22 determines whether to have received the alternator stop command from the ECU 30, i.e. whether the alternator drive command has been turned off, in step S203.

When it is determined that the control IC 22 has not received the alternator stop command (NO in step S203), the second engine starting routine proceeds to step S204*a*.

In step S204*a*, the control IC 22 determines whether an alternator status flag, which is described later, is set to 0.

Upon determining that the alternator status flag is set to 0 (YES in step S204*a*), the control IC 22 determines, based on the rotation information obtained in step S202, whether it has recognized rotation of the rotor 21*a* of the alternator 21 since authorization of the power running operation of the alternator 21 in step S204*b*.

When it is determined that the control IC 22 has recognized rotation of the rotor 21*a* of the alternator 21 (YES in step S204*b*), the second engine starting routine proceeds to step S205. In step S205, the control IC 22 sets therein a predetermined alternator status flag to 1, and sends, as the status signal, a rotation recognition signal indicative of the alternator status flag of 1 to the ECU 30.

Note that the alternator status flag is, for example, a bit having four different logical values represented by 0, 1, 2, and 3. The initial value of the alternator status flag is set to 0 representing that the control IC 22 has not recognized rotation of the rotor 21*a* of the alternator 21. That is, the alternator status flag, which is set to 1, represents that the control IC 22 has recognized rotation of the rotor 21*a* of the alternator 21.

Otherwise, when it is determined that the control IC 22 has not recognized rotation of the rotor 21*a* of the alternator 21 (NO in step S204*b*), the control IC 22 terminates the second engine starting routine.

In addition, when it is determined that the alternator status flag is not set to 0 (NO in step S204*a*), the second engine starting routine proceeds to step S206*a*.

In step S206*a*, the control IC 22 determines whether the alternator status flag is set to 1.

When it is determined that the alternator status flag is set to 1 (YES in step S206*a*), the first starting routine proceeds to step S206*b*.

In step S206*b*, the control IC 22 determines, based on the rotation information obtained in step S202, whether it has recognized the phase of one of the three-phase coils to which the driver 14 should energize, i.e. should supply an AC current; the phase of one of the three-phase coils will be referred to as an energization phase hereinafter.

When it is determined that the control IC 22 has recognized the energization phase (YES in step S206*b*), the second engine starting routine proceeds to step S207.

In step S207, the control IC 22 sets therein the alternator status flag to 2, and sends, as the status signal, a phase recognition signal indicative of the alternator status flag of 2 to the ECU 30. The alternator status flag, which is set to 2, represents that the control IC 22 has recognized the energization phase.

Otherwise, when it is determined that the control IC 22 has not recognized the energization phase (NO in step S206*b*), the control IC 22 terminates the second engine starting routine.

In addition, when it is determined that the alternator status flag is not set to 1 (NO in step S206*a*), the first starting routine proceeds to step S208*a*.

In step S208*a*, the control IC 22 determines whether the alternator status flag is set to 2.

When it is determined that the alternator status flag is set to 2 (YES in step S208*a*), the second starting routine proceeds to step S208*b*.

In step S208*b*, the control IC 22 determines whether driver 24 has started to perform a current control task that causes the alternator 21 to operate in the power running mode to convert the DC power supplied from the battery 31 into AC power to be supplied to one of the three-phase coils having the identified phase. That is, in step S208*b*, the control IC 22 determines whether the alternator 21 has operated in the power running mode based on whether the driver 24 has started to perform the current control task.

When it is determined that the driver 24 has started to perform the current control task so that the control IC 22 determines that the alternator 21 has operated in the power running mode (YES in step S208*b*), the second engine starting routine proceeds to step S209. In step S209, the control IC 22 sets therein the alternator status flag to 3, and sends, as the status signal, the power-running mode start signal indicative of the alternator status flag of 3 to the ECU 30. The alternator status flag, which is set to 3, represents that the alternator 21 has operated in the power running mode.

Otherwise, when it is determined that the driver 24 has not started to perform the current control task so that the control IC 22 determines that the alternator 21 has not operated in the power running mode (NO in step S208*b*), the control IC 22 terminates the second engine starting routine.

In addition, when it is determined that the alternator status flag is not set to 2 (NO in step S208*a*), the control IC 22 terminates the second engine starting routine.

When it is determined that the control IC 22 has received the alternator stop command (YES in step S203), the second engine starting routine proceeds to step S210. In step S210, the control IC 22 causes the driver 24 to stop the power running operation of the alternator 21, i.e. causes the driver 24 to deactivate the alternator 21, switches the alternator status flag to 0, and sends an alternator stop signal to the ECU 30. Thereafter, the control IC 22 terminates the second engine starting routine.

The following specifically describes how the ECU 30 and the control IC 22 perform the respective first and second engine starting routines for starting the engine 10, which has been automatically stopped.

Figure 4:
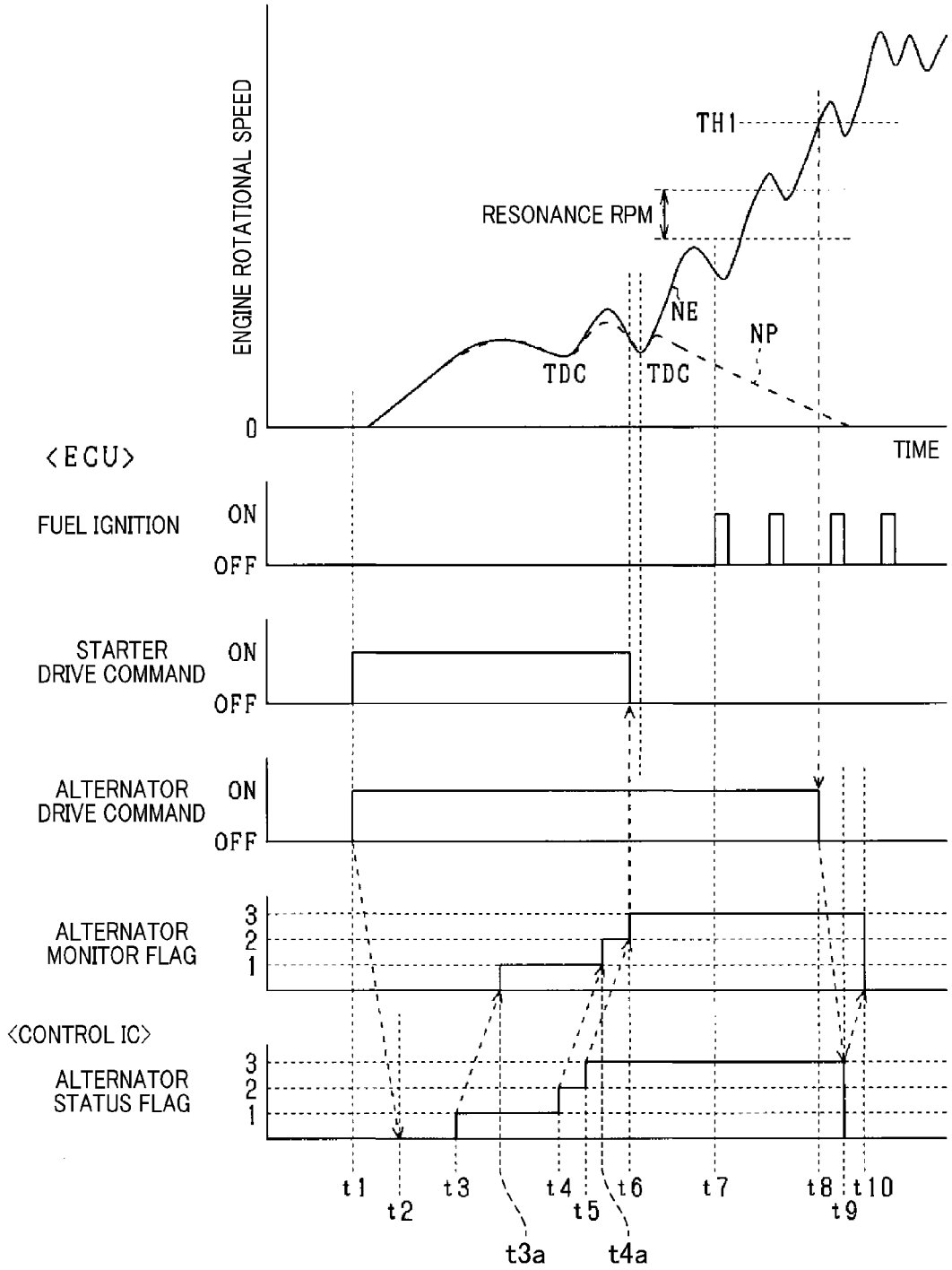
FIG. 4 is a timing chart schematically illustrating how the ECU and the control IC perform the respective first and second starting routines according to the first embodiment of the present disclosure.

Referring to FIG. 4, the engine 10 is shut down before time t1. A driver of the vehicle V inputs one of the engine restart requests to the ECU 30 at the time t1. For example, a driver of the vehicle V depresses the accelerator pedal 41 or driver completely releases the brake pedal 43. Note that, when performing initial starting of the engine 10, a driver of the vehicle V operates the ignition key to the starter-on position at the time t1.

When the engine restart request is input to the ECU 30, the determination in step S104 is affirmative, so that the ECU 30 generates the starter drive command and the alternator drive command, and sends the starter drive command and the alternator drive command to the respective relay 33 and the control IC 22 (see steps S105 and S106).

The starter drive command causes the starter 11 to be activated, so that rotational power of the starter 11 is transferred to the rotating shaft 13 of the engine 10. This causes the rotating shaft 13 of the engine 10 to start cranking. This results in the engine rotational speed NE, which is illustrated as a solid curve, increasing together with an increase of the rotational speed of the pinion 12, which is illustrated as a dashed curve and will be referred to as a pinon rotational speed NP. The rotation of the rotating shaft 13 causes the rotor 21*a* of the alternator 21, which is belt-connected to the rotating shaft 13, to rotate.

The alternator drive command sent to the control IC 22 causes the control IC 22 to recognize the alternator drive command at time t2 at which a communication delay between the ECU 30 and the control IC 22 has elapsed since the time t1. This causes the control IC 22 to recognize authorization of the power running operation of the alternator 21 (see step S201). After the time t2, the control IC 22 is capable of recognizing rotation of the rotor 21*a* of the alternator 21.

Thereafter, the alternator status flag is switched from 0 to 1 at time t3, which represents recognition of rotation of the rotor 21*a* has been completed (see steps S204*a*, S204*b*, and S205). Thereafter, at time t4, the alternator status flag is switched from 1 to 2 at time t4, which represents recognition of the energization phase has been completed (see steps S206*a*, S206*b*, and S207). After the time t4, the alternator status flag is switched from 2 to 3 at time t5, which represents that the power running operation of the alternator 21 has been started (see steps S208*a*, S208*b*, and S209).

The status signal indicative of the alternator status flag of 1 is received by the ECU 30 at time t3*a* at which a predetermined communication delay has elapsed since the time t3. This results in the ECU 30 obtaining the alternator status flag of 1 as an alternator monitor flag of 1. Similarly, the status signal indicative of the alternator status flag of 2 is received by the ECU 30 at time t4*a* at which a predetermined communication delay has elapsed since the time t4. This results in the ECU 30 obtaining the alternator status flag of 2 as the alternator monitor flag of 2. Additionally, the status signal indicative of the alternator status flag of 3 is received by the ECU 30 at time t6 at which a predetermined communication delay has elapsed since the time t5. This results in the ECU 30 obtaining the alternator status flag of 3 as the alternator monitor flag of 3.

The engine rotational speed NE increases based on the working of the starter 11, and decreases when the rotational angular position of the rotating shaft 13 approaches the next compression TDC of a corresponding cylinder 10C due to compression reaction force in the corresponding cylinder 10C. When the rotational angular position of the rotating shaft 13 has passed through the compression TDC, the engine rotational speed NE increases based on expansion of the combustion chamber of the corresponding cylinder 10C. That is, when the rotational angular position of the rotating shaft 13 has passed through the compression TDC, the engine rotational speed NE, i.e. a rotational speed of the ring gear 14, temporarily becomes higher than the pinion rotational speed NP.

At the time t6, the ECU 30 has recognized that the power running operation of the alternator 21 has started (see step S107). At that time, if the rotational angular position of the rotating shaft 13 at the time t6 is located within the high-pressure angular range (see YES in step S108), the ECU 30 turns off the starter-drive command, thus stopping the starter 11 (see step S109). That is, the deactivating timing of the starter 11 is set to be immediately before the next compression TDC. After the time t6, the alternator 21 only applies torque to the rotating shaft 13 of the engine 10.

Even if the starter 11 is activated so that noise is generated due to engagement of the pinion 12 with the ring gear 14, the ECU 30 is configured to deactivate the starter 11 immediately after recognizing the start of the power running operation of the alternator 21. This configuration minimizes the activation of the starter 11, thus reducing noise generated by engagement of the pinon 12 with the ring gear 14. Such noise will be referred to as gear noise hereinafter.

The pressure in the cylinder 10C is maximized when the rotational angular position of the rotating shaft 13 is located at the compression TDC, resulting in transfer torque through the engagement of the pinion 12 with the ring gear 14 being maximized. The above configuration of the ECU 30, which shuts down the starter 11 immediately before the compression TDC, resulting in less gear noise.

An increase of the engine rotational speed NE over the pinion rotational speed NP after the starter 11 is shut down immediately before the compression TDC enables the pinion 12 to be disengaged with the ring gear 14, thus preventing the occurrence of gear noise after disengagement of the pinon 12 with the ring gear 14.

After the ECU 30 has recognized the start of the power running operation of the alternator 21 at the time t6, the ECU 30 starts the combustion task T1 including the fuel injection control task and ignition timing control task for each cylinder 10C (see step S110). FIG. 4 illustrates that the first fuel injection into the intake manifold or a corresponding cylinder 10C during the compression cycle is performed at time t7 after recognition of the power running operation of the alternator 21, so that the air-fuel mixture in each cylinder 10C is ignited. This results in the air-fuel mixture in each cylinder 10C of the engine 10 being combusted, thus generating combustion torque. The combustion torque and torque applied from the alternator 21 to the rotating shaft 13 of the engine 10 increase the engine rotational speed NE of the engine 10. This enables the engine rotational speed NE to rapidly pass through a predetermined resonance engine rotational speed range corresponding to a predetermined resonance frequency range of the engine 10.

That is, the engine 10 has the predetermined resonance frequency range corresponding to the predetermined resonance engine rotational speed range that is lower than a predetermined idle speed. For example, the engine 10 according to the first embodiment has the predetermined resonance frequency range corresponding to the predetermined resonance engine rotational speed range from 300 to 400 RPM. On the other hand, a cranking rotational speed of the rotating shaft 13 by only the cranking of the starter 11 is set to for example, 200 RPM at the time t6 according to the first embodiment. In these circumstances, the ECU 30 starts the combustion task T1 after recognizing starting of the power running operation of the alternator 21 at the time t6, making it possible to start the combustion task T1 before the engine rotational speed NE reaches the resonance engine rotational speed range. This achieves desired combustion torque to increase the engine rotational speed NE.

Thereafter, when the engine rotational speed NE have arrived at a predetermined threshold speed TH1 at time t8, the ECU 30, which has recognized this arrival, turns off the alternator drive command, in other words, sends the alternator stop command to the control IC 22 (see step S111). In response to the alternator stop command, the control IC 22 stops the power running operation of the alternator 21, and sends the alternator stop signal to the ECU 30 at time t9 (see step S210).

As described above, the engine starting system 100 according to the first embodiment achieves the following advantageous effects.

The starter 11, which is gear-connected to the rotating shaft 13 of the engine 10, causes gear noise due to engagement of the pinion 12 with the ring gear 14. Such gear noise might become greater when the rotational angular position of the rotating shaft 13 approaches the next compression TDC of a corresponding cylinder 10C due to compression reaction force in the corresponding cylinder 10C. On the other hand, it is necessary to start the power running operation of the alternator 20 until the starter 11 is turned off in order to sufficiently ensure the startability of the engine 10.

From these viewpoints, the engine starting system 100 is configured to, when determining that the power running operation of the alternator 21 has been started, deactivate the starter 11 before the rotational angular position of the rotating shaft 13 reaches the next compression TDC. This configuration enables both reduction in gear noise and sufficient ensuring of the startability of the engine 10 to be achieved. This configuration also results in less wear of the pinon 12 and ring gear 14.

In particular, the ECU 30 is configured to shut down the starter 11 when having recognized the power running operation of the alternator 21. This configuration enables the starter 11 to be reliably deactivated while ensuring a proper overlap period between the activating period of the starter 11 and the power running period of the alternator 11. This configuration results in efficient starting of the engine 10 using both the starter 11 and the alternator 21.

That is, the above configuration of the engine starting system 100 cranks the engine 10 using both the starter 11 and the alternator 21 while properly deter mining deactivation timing of the starter 11 relative to the next compression TDC. This enables the maximum output torque of the alternator 21 to be reduced while reducing redundant activation of the starter 11, making it possible to use the generator apparatus 20 that is sufficiently downsized. This therefore results in the engine starting system 100 having a lower manufacturing cost.

The control IC 22 is configured to send, to the ECU 30 as the status signal, the power-running mode start signal indicative of start of the power running operation of the alternator 21 while the rotor 21*a* of the alternator 21 is rotating based on rotation of the rotating shaft 13 by the starter 11. The ECU 30 is configured to determine, based on the power-running mode start signal, that the alternator 21 has started to operate in the power running mode.

These configurations of the control IC 22 and ECU 30 enable the ECU 30 to 1. Properly determine, based on the power-running mode start signal, start of the power running mode of the alternator 21

2. Monitor how the alternator 21 is driven, thus properly determining the timing to deactivate the starter 11.

The ECU 30 is configured to determine, upon having determined that the power running operation of the alternator 21 has been started, the timing to deactivate the starter 11 immediately before the next compression TDC in a corresponding cylinder 10C, in other words, immediately before the timing when the compression pressure in the corresponding cylinder 10C is maximized. This configuration prevents the starter 11 from being activated when the rotational angular position of the rotating shaft 13 is located at the next compression TDC in a corresponding cylinder 10C. That is, this configuration prevents the starter 11 from being continuously activated at the timing when the transfer torque through the engagement of the pinion 12 with the ring gear 14 is maximized. This configuration therefore results in less gear noise.

The ECU 30 is configured to start, upon having recognized start of the power running operation of the alternator 21, the combustion task T1 including the fuel injection control task and ignition timing control task for each cylinder 10C until the rotational angular position of the rotating shaft 13 reaches the predetermined resonance engine rotational speed range corresponding to the predetermined resonance frequency range.

This configuration enables both the combustion torque based on the combustion task T1 and torque applied from the alternator 21 to the rotating shaft 13 of the engine 10 to increase the engine rotational speed NE of the engine 10. This enables the engine rotational speed NE to pass through the resonance engine rotational speed range corresponding to the resonance frequency range of the engine 10 in a shorter time, resulting in less engine vibrations. This configuration, which starts the combustion task T1 after start of the power running operation of the alternator 21, enables the fuel economy of the engine 10 to be improved and the alternator 20 to be downsized. Additionally, the power running operation of the alternator 21 results in an increase of the engine rotational speed NE to thereby increase inertia force of the engine 10 with an increase of the engine rotational speed NE. This therefore results in a smaller amount of fuel being required to cause first firing in a cylinder 10C.

Modification of the First Embodiment

The ECU 30 according to the first embodiment is configured to shut down the starter 11 in accordance with the power-running mode start signal sent from the control IC 22 as the status signal (see steps S107 to S109). The present disclosure is however not limited to this configuration.

Specifically, the ECU 30 according to a first modification of the first embodiment is configured to shut down the starter 11 in accordance with the rotation recognition signal sent from the control IC 22 as the status signal. In addition, the ECU 30 according to a second modification of the first embodiment is configured to shut down the starter 11 in accordance with the phase recognition signal sent from the control IC 22 as the status signal.

The ECU 30 has larger processing load during startup of the engine 10, which may result in communication delay between the ECU 30 and the control IC 22. On the other hand, the control IC 22 is programmed to sequentially perform recognition of rotation of the rotor 21*a*, recognition of the phase of one of the three-phase coils to which the driver 14 should energize, and recognition of the power running operation of the alternator 21 over time.

That is, the first recognition of rotation of the rotor 21*a* or the second recognition of the phase of one of the three-phase coils to which the driver 14 should energize enables the start of the power running operation of the alternator 21 following the first and second recognitions to be easily estimated.

In view of these circumstances, the ECU 30 according to the first or second modification is configured to shut down the starter 11 in accordance with the rotation recognition signal or the phase recognition signal sent from the control IC 22 as the status signal. This configuration enables, after start of the power running operation of the alternator 21, the starter 11 to be turned off earlier. This results in disengagement of the pinon 12 with the ring gear 14 of the rotating shaft 13 while the rotational angular position of the rotating shaft 13 passes through one or more compression TDC earlier than the compression TDC closest to the start of the power running operation of the alternator 21. This ensures a sufficient deactivating period before the arrival of the compression TDC closest to the start of the power running operation of the alternator 21, resulting in further less gear noise.

In step S110, the ECU 30 can perform the combustion task T1 in the following procedure including the following steps S110*a* to S110*c* illustrated in FIG. 2 as two-dot chain lines Specifically, in step S110*a*, the ECU 30 determines whether the rate of increase, i.e. the gradient of increase, of the engine rotational speed NE after the start of the power running operation of the alternator 21 is less than a predetermined threshold rate TH2. Specifically, the rate of increase of the engine rotational speed NE after the start of the power running operation of the alternator 21 may be low if there is one of (1) The state of charge (SOC) of the battery 31, i.e. the output voltage of the battery 31, is low (2) The engine 10 is in a low-temperature condition (3) The control IC 22 performs a current limitation task to limit the flow of a current through each switching element of the driver 24 depending on the temperature of the switching element.

The SOC of the battery 31, the temperature of the engine 10, and the temperature of each switching element will be referred to as engine-rotation change parameters.

Figure 5:
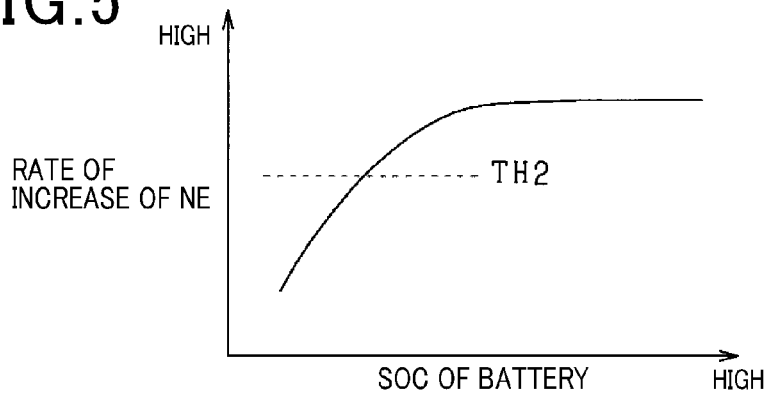
FIG. 5 is a graph illustrating the relationship between the variation of the rate of increase of an engine rotational speed and the corresponding variation of a state of charge of a battery illustrated in FIG. 1.

That is, the ECU 30 previously stores, in its memory unit, information I1 indicative of the relationship between the variation of the rate of increase of the engine rotational speed NE and the corresponding variation of each of the engine-rotation change parameters. Then, the ECU 30 detects a value of each of the engine-rotation change parameters using, for example, a corresponding one of the sensors included in the sensors SS, and extracts, from the information I1, values of the rate of increase of the engine rotational speed NE matching with the respective detected values of the corresponding engine-rotation change parameters. FIG. 5 schematically illustrates a graph showing the relationship between the variation of the rate of increase of the engine rotational speed NE and the corresponding variation of the SOC of the battery 31.

On the basis of the extracted values of the rate of increase of the engine rotational speed NE, the ECU 30 calculates an estimated value of the rate of increase of the engine rotational speed NE. Then, the ECU 30 determines whether the estimated value of the rate of increase of the engine rotational speed NE is lower than the predetermined threshold rate TH2 in step S110*a*.

Upon determining that the estimated value of the rate of increase of the engine rotational speed NE is lower than the predetermined threshold rate TH2 (YES in step S110*a*), the ECU 30 starts the combustion task T1 before the engine rotational speed NE reaches the resonance engine rotational speed range in step S110*b* set forth above. The resonance engine rotational speed range is illustrated in FIG. 2 as RESONANCE RPM RANGE.

Otherwise, upon determining that the estimated value of the rate of increase of the engine rotational speed NE is equal to or higher than the predetermined threshold rate TH2 (NO in step S110*a*), the ECU 30 waits for starting the combustion task T1 while the engine rotational speed NE passes through the resonance engine rotational speed range in step S110*c*. Then, the ECU 30 starts the combustion task T1 when the engine rotational speed NE has reached the threshold speed TH1 of a predetermined speed immediately before the threshold speed TH1 in step S110*c*.

Note the threshold rate TH2 can be obtained when the engine starting system 100 is operating under the conditions that (1) The SOC of the battery 31 is a predetermined value (2) The engine 10 has warmed up (3) The current limitation task is not carried out by the control IC 22.

The above modification is configured to start the combustion task T1 until the rotational angular position of the rotating shaft 13 reaches the predetermined resonance engine rotational speed range when it is determined that the rate of increase of the engine rotational speed NE is lower than the threshold rate TH2. This makes it possible to preferentially achieve the rapid passage of the engine rotational speed NE through the resonance engine rotational speed range corresponding to the resonance frequency range of the engine 10. Otherwise, the above modification is configured to start the combustion task T1 after the rotational angular position of the rotating shaft 13 reaches the predetermined resonance engine rotational speed range when it is determined that the rate of increase of the engine rotational speed NE is equal or higher than the threshold rate TH2. This makes it possible to preferentially achieve improvement of the fuel economy of the engine 10.

Second Embodiment

The following describes an engine starting system according to the second embodiment of the present disclosure. The structure and/or functions of the engine starting system according to the second embodiment differ from the engine starting system 100 according to the first embodiment in the following points. So, the following mainly describes the different points.

The engine starting system according to the second embodiment is configured such that the ECU 30 performs a first engine starting routine that is partly different from the first engine starting routine according to the first embodiment.

Specifically, the first engine starting routine is configured such that the ECU 30, which have received the phase recognition signal sent from the control IC 22 as the status signal, waits until a predetermined timing at which a selected combustion TDC arrives. After the waiting, the ECU 30 stops the starter 11.

Figure 6:
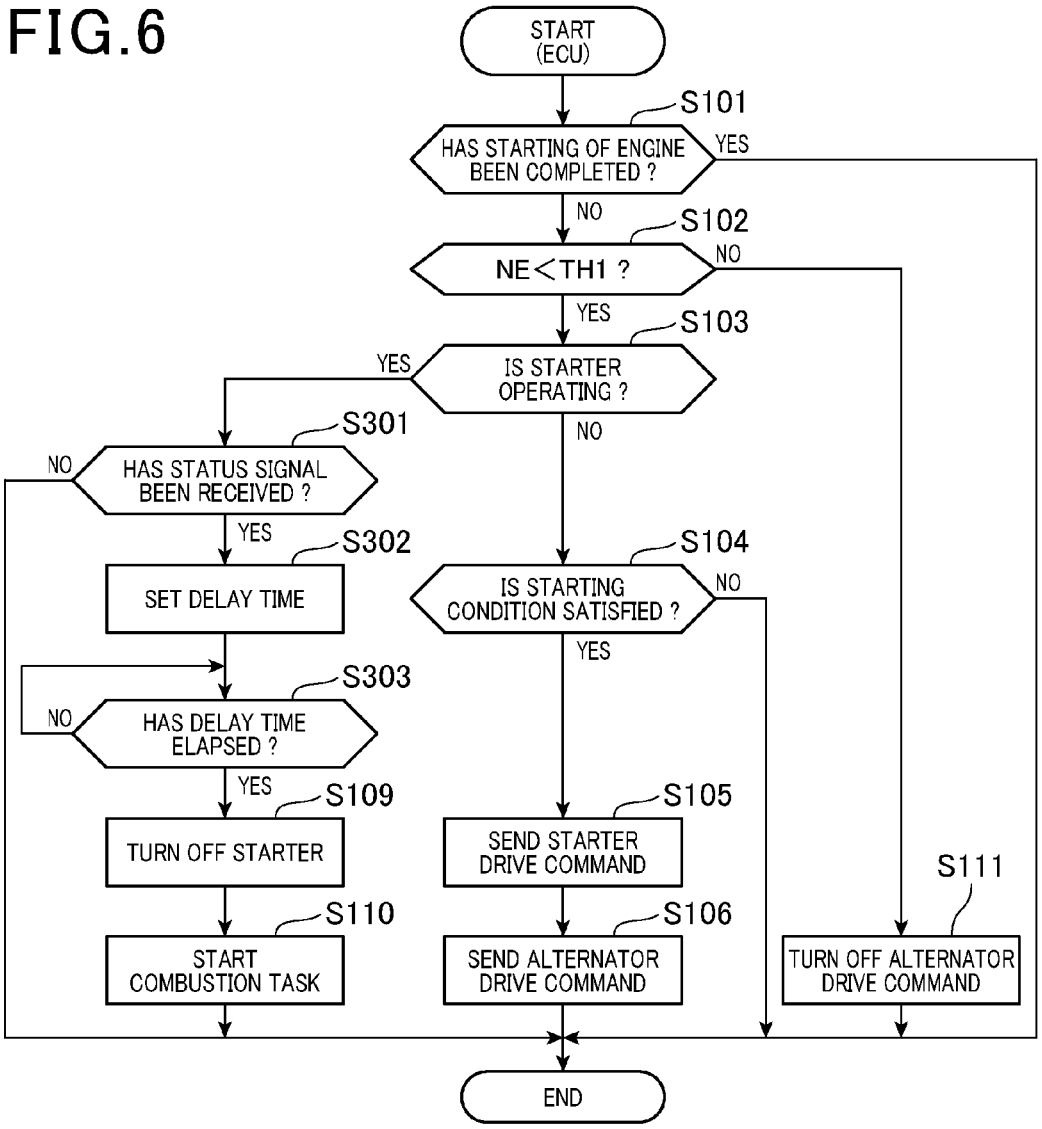
FIG. 6 is a flowchart schematically illustrating a first starting routine periodically carried out by the ECU illustrated in FIG. 1 according to the second embodiment of the present disclosure.

FIG. 6 schematically illustrates the first engine starting routine according to the second embodiment repeatedly carried out by the ECU 30 in the first control period. The operations in steps S107 and S108 illustrated in FIG. 2 are replaced with the operations in steps S301 to S303 illustrated in FIG. 6.

When it is determined that starting of the engine 10 has not been completed (NO in step S101), the engine rotational speed NE is lower than the predetermined threshold TH1 (YES in step S102), and the starter 11 is operating (YES in step S103), the first engine starting routine proceeds to step S301.

In step S301, the ECU 30 determines whether to have received the phase recognition signal as the status signal. Upon determining that the ECU 30 has received the phase recognition signal as the status signal (YES in step S301), the first engine starting routine proceeds to step S302.

In step S302, the ECU 30 sets a delay time Td based on the present rotational angular position of the rotating shaft 13 at the receiving timing of the phase recognition signal. The delay time Td is configured such that, when the delay time Td has elapsed since the receiving timing of the phase recognition signal, the rotational angular position of the rotating shaft 13 is located within the high-pressure angular range immediately before a selected combustion TDC.

Specifically, the ECU 30 stores in its memory unit, the rotational angular position of the rotating shaft 13 at the automatic stop of the engine 10 as a stop angular position. On the basis of the stop angular position, the ECU 30 detects the rotational angular position of the rotating shaft 13 when having received the phase recognition signal in step S302. Then, the ECU 30 sets, based on the detected rotational angular position, the delay time Td to be shorter than a predicted time up to the next compression TDC in step S302.

Subsequently, the ECU 30 determines whether the delay time Td has elapsed since the receiving timing of the phase recognition signal in step S303. Upon deter mining that the delay time Td has not elapsed since the receiving timing of the phase recognition signal (NO in step S303), the ECU 30 repeatedly performs the determination in step S303.

Otherwise, upon determining that the delay time Td has elapsed since the receiving timing of the phase recognition signal (YES in step S303), the ECU 30 turns off the starter drive command, thus deactivating, i.e. turning off, the starter 11 in step S109 described above.

Figure 7:
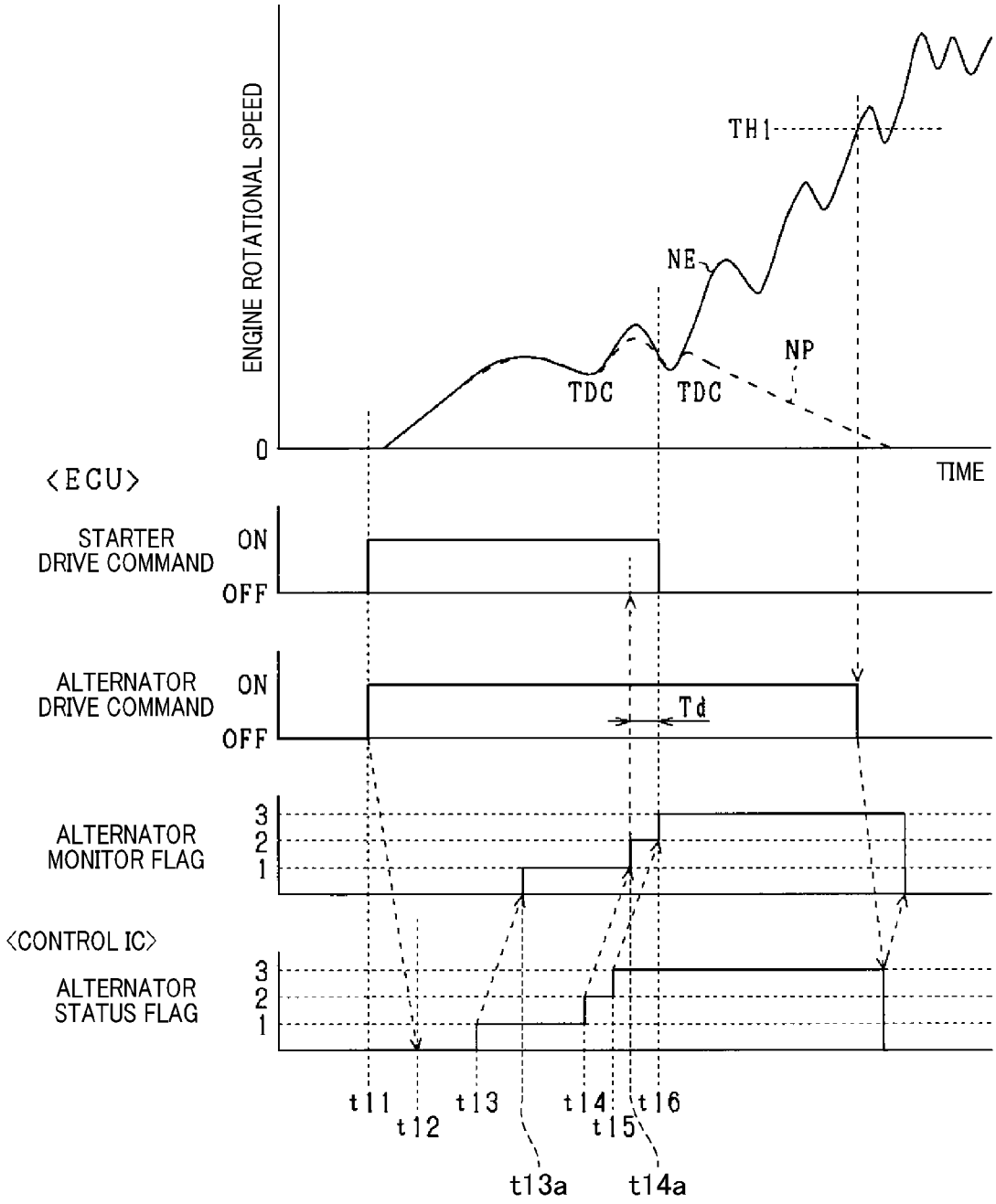
FIG. 7 is a timing chart schematically illustrating how the ECU and the control IC perform the respective first and second starting routines according to the second embodiment of the present disclosure.

FIG. 7 is a timing chart schematically illustrating how the ECU 30 and the control IC 22 perform the respective first and second engine starting routines for starting the engine 10, which has been automatically stopped. Note that, because some operations in FIG. 7 are changed from those in FIG. 4, the descriptions of the remaining operations in FIG. 7, which are identical to those in FIG. 4, are omitted.

Referring to FIG. 7, the engine 10 is shut down before time t11. A driver of the vehicle V inputs one of the engine restart requests to the ECU 30 at the time t11. When the engine restart request is input to the ECU 30, the determination in step S104 is affirmative, so that the ECU 30 sends the starter drive command to the relay 33 (see step S105) and the alternator drive command to the control IC 22 at the time t11 (see steps S105 and S106). This causes the starter 11 to be activated to crank the rotating shaft 13 of the engine 10.

The alternator drive command is received by the control IC 22 at time t12. This causes the control IC 22 to recognize authorization of the power running operation of the alternator 21 (see step S201). After the time t12, the control IC 22 is capable of recognizing rotation of the rotor 21*a* of the alternator 21.

Thereafter, the alternator status flag is switched from 0 to 1 at time t13, which represents recognition of rotation of the rotor 21*a* has been completed (see steps S204*a*, S204*b*, and S205). Thereafter, the alternator status flag is switched from 1 to 2 at time t14, which represents recognition of the energization phase has been completed (see steps S206*a*, S206*b*, and S207). After the time t14, the alternator status flag is switched from 2 to 3 at time t15, which represents that the power running operation of the alternator 21 has been started (see steps S208*a*, S208*b*, and S209).

The status signal indicative of the alternator status flag of 1 is received by the ECU 30 at time t13*a* at which the predetermined communication delay has elapsed since the time t13. This results in the ECU 30 obtaining the alternator status flag of 1 as the alternator monitor flag of 1. Similarly, the status signal indicative of the alternator status flag of 2 is received by the ECU 30 at time t14*a* at which the predetermined communication delay has elapsed since the time t14 (see step S301). This results in the ECU 30 obtaining the alternator status flag of 2 as the alternator monitor flag of 2.

When receiving the status signal indicative of the alternator status flag of 2 at the time t14*a*, the ECU 30 sets the delay time Td (see step S302). When the delay time Td has elapsed since the time t14*a*, the ECU 30 turns off the starter-drive command, thus stopping the starter 11 at time t16 (see step S303 and S109). This results in deactivating timing of the starter 11 being set to be immediately before the next compression TDC. After the time t16, the alternator 21 only applies torque to the rotating shaft 13 of the engine 10. Note that the status signal indicative of the alternator status flag of 3 is received by the ECU 30 at the timing when a predetermined communication delay has elapsed since the time t15. This results in the ECU 30 obtaining the alternator status flag of 3 as the alternator monitor flag of 3. Note that the ECU 30 can change the alternator monitor flag from 2 to 3 when the delay time Td has elapsed since the time t14*a*.

When receiving the phase recognition signal at the time t14*a*, the power running operation of the alternator 20 has been performed, so that torque based on the power running operation of the alternator 20 has been generated to crank the engine 10 in consideration of the communication delay. Setting the delay time enables cranking of the engine 10 based on the starter 11 to be smoothly shifted to cranking of the engine 10 based on the alternator 21. That is, the ECU 30 determines the timing to stop the starter 11 under the occurrence of the communication delay, thus further properly deactivating the starter 11. In addition, the ECU 30 reliably deactivates the starter 11 immediately before a desired, i.e. a selected, combustion TDC. This configuration further establishes superior balance between reduction in gear noise and sufficient ensuring of the startability of the engine 10.

In place of setting the delay time Td relative to the receiving of the phase recognition signal, the ECU 30 can be configured to set the delay time Td relative to the receiving of the rotation recognition signal, and deactivate the starter 11 when the delay time Td has elapsed since the receiving of the rotation recognition signal. In addition, the ECU 30 can be configured to set the delay time Td relative to the receiving of the power-running mode start signal, i.e. the power-running mode recognition signal, and deactivate the starter 11 when the delay time Td has elapsed since the receiving of the power-running mode start signal.

Third Embodiment

The following describes an engine starting system according to the third embodiment of the present disclosure. The structure and/or functions of the engine starting system according to the third embodiment differ from the engine starting system 100 according to the first embodiment in the following points. So, the following mainly describes the different points.

The engine starting system according to the third embodiment is configured such that the ECU 30 performs a first engine starting routine that is partly different from the first engine starting routine according to the first embodiment.

Specifically, the first engine starting routine causes the ECU 30 to determine whether the power running operation of the alternator 21 has been started without using communication information sent from the control IC 22. Specifically, the ECU 30 obtains a state change parameter representing how the state of the engine starting system has changed since start of activation of the starter 11. The state change parameter includes, for example, a parameter indicative the amount of discharge from the battery 31, or a parameter indicative of the amount of power supply from the battery 31 to the stator 11. Specifically, at least one sensor included in the sensors SS repeatedly measures a value of the state change parameter, and repeatedly sends the measured value of the state change parameter to the ECU 30. For example, a voltage sensor included in the sensors SS is disposed close to the positive terminal of the battery 31, and repeatedly measures the terminal voltage across the battery 31, and repeatedly sends the measured terminal voltage across the battery 31 to the ECU 30. As another example, a current sensor included in the sensors SS is disposed close to a current supply path between the battery 31 and the starter 11, and repeatedly measures a current supplied from the battery 31 to the starter 11, and repeatedly sends the measured current to the ECU 30.

That is, the ECU 30 determine whether the power running operation of the alternator 21 has been started according to how the state change parameter has been changed since start of activation of the starter 11.

Figure 8:
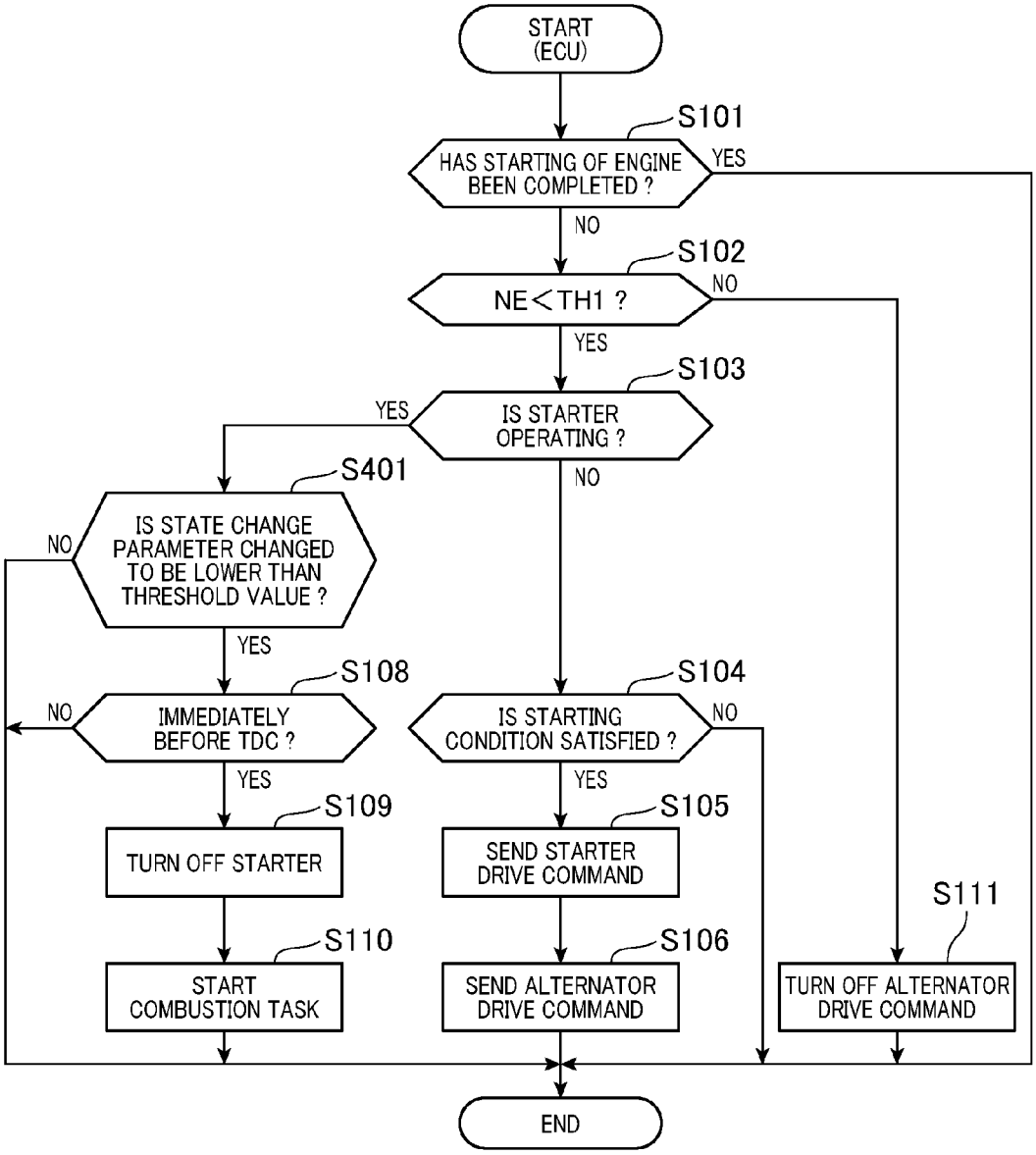
FIG. 8 is a flowchart schematically illustrating a first starting routine periodically carried out by the ECU illustrated in FIG. 1 according to the third embodiment of the present disclosure.

FIG. 8 schematically illustrates the first engine starting routine according to the third embodiment repeatedly carried out by the ECU 30 in the first control period. The operation in step S107 illustrated in FIG. 2 is replaced with the operation in step S401 illustrated in FIG. 8.

When it is determined that starting of the engine 10 has not been completed (NO in step S101), the engine rotational speed NE is lower than the predetermined threshold TH1 (YES in step S102), and the starter 11 is operating (YES in step S103), the first engine starting routine proceeds to step S401.

In step S401, the ECU 30 sequentially obtains values of the state change parameter from the corresponding sensor included in the sensors SS. Then, the ECU 30 determines whether the power running operation of the alternator 21 has been started according to how the state change parameter has been changed since start of activation of the starter 11. For example, the ECU 30 determines whether the amount of discharge from the battery 31 is reduced to be lower than a predetermined threshold value or the amount of power supply from the battery 31 to the starter 11 is reduced to be lower than a predetermined threshold value.

That is, if the power running operation of the alternator 21 is started while the starter 11 is operating, the number of targets to which power discharged from the battery 21 should be supplied increases from the starter 11 only to both the starter 11 and the alternator 21. This causes the amount of discharge from the battery 11, i.e. the terminal voltage across the battery 31, to decrease. In addition, if the power running operation of the alternator 21 is started while the starter 11 is operating, the amount of power consumption by the starter 11 decrease, so that the amount of power supply from the battery 31 to the starter 11, i.e. the amount of current supplied to the starter 11 is reduced.

From this viewpoint, the ECU 30 determines whether the power running operation of the alternator 21 has been started based on whether the terminal voltage across the battery 31 decreases to be lower than a predetermined threshold voltage or the current supplied to the starter 11 from the battery 31 is lower than a predetermined threshold value in step S401.

Upon determining that the power running operation of the alternator 21 has been started (YES in step S401), the ECU 30 determines whether the rotational angular position of the rotating shaft 13 of the engine 10 is located within the high-pressure angular range immediately before the next compression TDC in step S108 set forth above.

Upon determining that the rotational angular position of the rotating shaft 13 of the engine 10 is located within the high-pressure angular range, the ECU 30 turns off the starter 11 in step S109 set forth above. Note that, upon determining that the power running operation of the alternator 21 has not been started (NO in step S401), or that the rotational angular position of the rotating shaft 13 of the engine 10 is not located within the high-pressure angular range (NO in step S108), the ECU 30 terminates the first engine starting routine.

Figure 9:
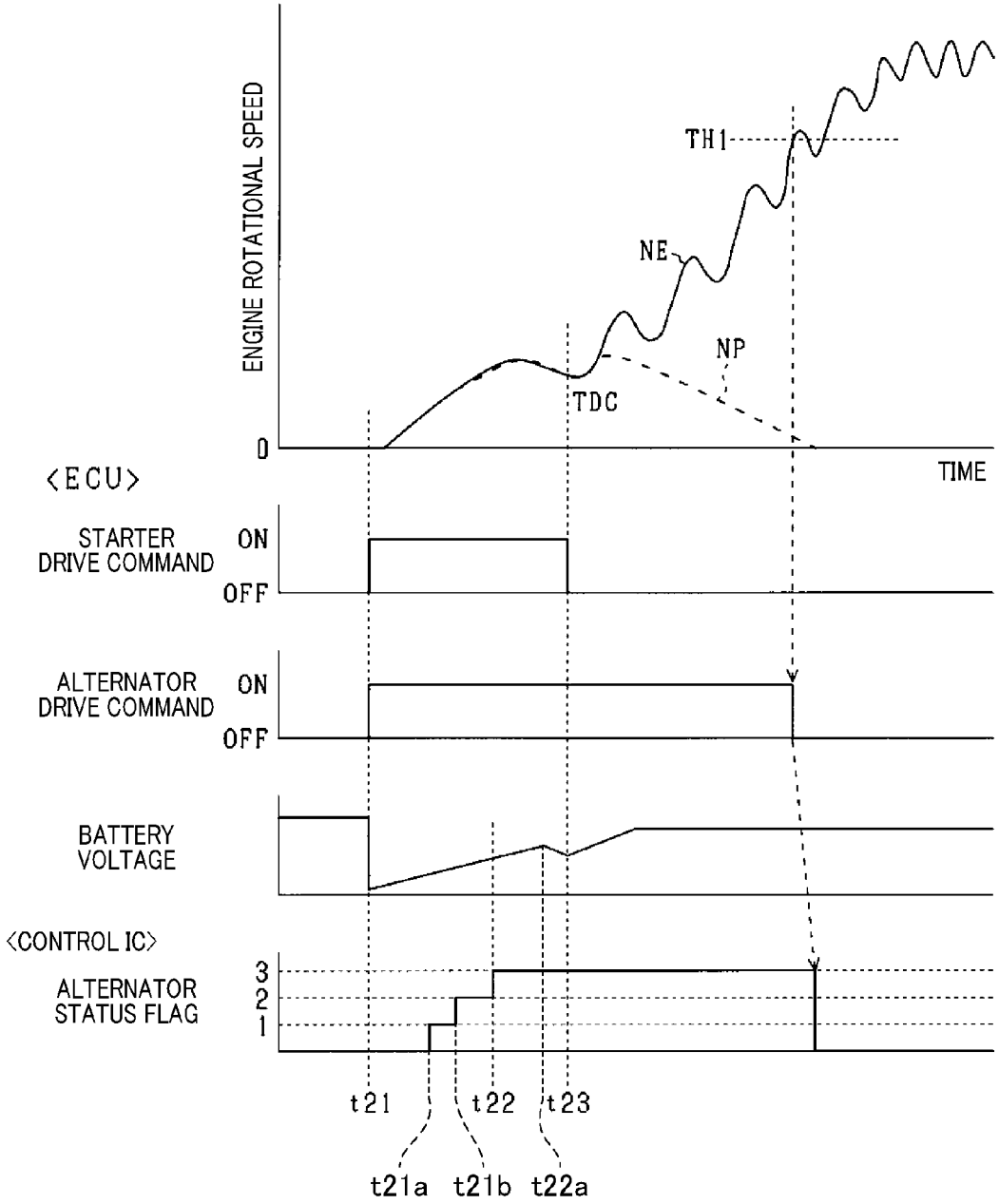
FIG. 9 is a timing chart schematically illustrating how the ECU and the control IC perform the respective first and second starting routines according to the third embodiment of the present disclosure.

FIG. 9 is a timing chart schematically illustrating how the ECU 30 and the control IC 22 perform the respective first and second engine starting routines for starting the engine 10, which has been automatically stopped. Note that, because some operations in FIG. 9 are changed from those in FIG. 4, the descriptions of the remaining operations in FIG. 9, which are identical to those in FIG. 4, are omitted.

Referring to FIG. 9, the engine 10 is shut down before time t21. A driver of the vehicle V inputs one of the engine restart requests to the ECU 30 at the time t21. When the engine restart request is input to the ECU 30, the determination in step S104 is affirmative, so that the ECU 30 sends the starter drive command to the relay 33 (see step S105) and the alternator drive command to the control IC 22 at the time t21 (see steps S105 and S106). This causes the starter 11 to be activated to crank the rotating shaft 13 of the engine 10.

The alternator drive command is received by the control IC 22. This causes the control IC 22 to recognize authorization of the power running operation of the alternator 21 (see step S201). Thereafter, the control IC 22 is capable of recognizing rotation of the rotor 21*a* of the alternator 21.

When the alternator status flag is switched from 0 to 1 at time t21*a*, which represents recognition of rotation of the rotor 21*a* has been completed (see steps S204*a*, 204*b*, and S205). Thereafter, the alternator status flag is switched from 1 to 2 at time t21*b*, which represents recognition of the energization phase has been completed (see steps S206*a*, 206*b*, and S207).

After the time t21*b*, the alternator status flag is switched from 2 to 3 at time t22, which represents that the power running operation of the alternator 21 has been started (see step S208*a*, S208*b*, and S209).

The working of both the starter 11 and the alternator 21 results in the amount of discharge from the battery 31 gradually increasing, so that the terminal voltage across the battery 31, which is illustrated as BATTERY VOLTAGE in FIG. 7, starts to fall down at time t22*a*.

When the terminal voltage across the battery 31 decreases to be lower than the predetermined threshold voltage at time t23 (see YES in step S401), and the rotational angular position of the rotating shaft 13 at the time t23 is located within the high-pressure angular range (see YES in step S108), the ECU 30 turns off the starter-drive command, thus stopping the starter 11 (see step S109).

The engine starting system according to third embodiment is configured such that the ECU 30 determines whether the power running operation of the alternator 21 has been started without using communication information sent from the control IC 22. This configuration achieves an advantageous effect of preventing delay of the timing to deactivate the starter 11 even if the ECU 30 has a large communication load during starting of the engine 10. Because the ECU 30 usually monitors the terminal voltage across the battery 31 or the current to be supplied to the starter 11, this configuration achieves the advantageous effect without using additional components.

The following describes modified configurations that the ECU 30 determines whether the power running operation of the alternator 21 has been started without using communication information sent from the control IC 22.

First, the following describes the first modified configuration.

When starting the power running operation of the alternator 20, the control IC 22 starts on-off switching operations of the switching elements of the driver 24. This results in the temperature of at least one the switching elements increasing. The first modified configuration of the ECU 30 determines whether the power running operation of the alternator 21 has been started as a function of how the temperature of at least one the switching elements has increased since activation of the starter 11.

Specifically, the sensors SS include a temperature sensor that repeatedly measures, as the state change parameter, the temperature of at least one switching element in the driver 24, and repeatedly sends the measured temperature of the at least one switching element to the ECU 30.

That is, the ECU 30 obtains the temperature of the at least one switching element in the driver 24 each time the temperature is sent from the temperature sensor thereto in step S410. Then, the ECU 30 determines whether the power running operation of the alternator 21 has been started based on whether the obtained temperature of the at least one switching element is equal to or higher than a predetermined threshold temperature in step S401.

Upon determining that the power running operation of the alternator 21 has been started upon determining that the currently obtained temperature of the at least one switching element is equal to or higher than the threshold temperature (YES in step S401), the ECU 30 performs the operations in steps S109 and S110 set forth above. This makes it possible to deactivate the starter 11. Note that the temperature sensor can be provided to the at least one switching element or to the inverter board.

Next, the following describes the second modified configuration.

When starting the power running operation of the alternator 20, the alternator 21 increases the engine rotational speed NE, resulting in that the quantity of intake air, in other words, the flow rate of intake air into the engine 10 increasing. The second modified configuration of the ECU 30 determines whether the power running operation of the alternator 21 has been started as a function of how the flow rate of intake air into the engine 10 has increased since activation of the starter 11.

Specifically, the sensors SS include an airflow meter provide in, for example, the intake manifold to repeatedly measure, as the state change parameter, the flow rate of intake air into the engine 10, and repeatedly sends the measured quantity of intake air to the ECU 30.

That is, the ECU 30 obtains the flow rate of intake air each time the quantity of intake air is sent from the airflow meter thereto in step S410. Then, the ECU 30 determines whether the power running operation of the alternator 21 has been started based on whether the obtained flow rate of intake air is equal to or higher than a predetermined threshold rate in step S401.

Upon determining that the power running operation of the alternator 21 has been started upon determining that the currently obtained flow rate of intake air is equal to or higher than the threshold rate (YES in step S401), the ECU 30 performs the operations in steps S109 and S110 set forth above. This makes it possible to deactivate the starter 11.

Next, the following describes the third modified configuration.

When starting the power running operation of the alternator 20, the alternator 21 increases the engine rotational speed NE. The third modified configuration of the ECU 30 determines whether the power running operation of the alternator 21 has been started as a function of the increase of the engine rotational speed NE.

Specifically, the ECU 30 obtains a current value of the engine rotational speed in step S410. Then, the ECU 30 determines whether the power running operation of the alternator 21 has been started based on whether the current value of the engine rotational speed NE is equal to or higher than a predetermined threshold RPM in step S401. For example, the threshold RPM is previously determined to a rotational speed of the rotating shaft 13 obtained by the torque generated by the starter 11 or the sum of 10 RPM and the cranking rotational speed of the rotating shaft 13.

Upon determining that the power running operation of the alternator 21 has been started upon determining that the current value of the engine rotational speed NE is equal to or higher than the threshold RPM (YES in step S401), the ECU 30 performs the operations in steps S109 and S110 set forth above. This makes it possible to deactivate the starter 11.

Fourth Embodiment

The following describes an engine starting system according to the fourth embodiment of the present disclosure. The structure and/or functions of the engine starting system according to the fourth embodiment differ from the engine starting system 100 according to the first embodiment in the following points. So, the following mainly describes the different points.

The engine starting system according to the fourth embodiment is configured such that the ECU 30 performs a first engine starting routine that is partly different from the first engine starting routine according to the first embodiment.

Specifically, the first engine starting routine causes the ECU 30 to perform an intake-air quantity limiting task that limits the quantity of intake air into the engine 10 to a predetermined limited quantity before determining that the power running operation of the alternator 21 has been started. That is, The higher the compression reaction force in each cylinder 10C is, the greater gear noise due to engagement of the pinion 12 with the ring gear 14 is when the engine 10 is cranked by the starter 11. From viewpoint, the ECU 30 according to the fourth embodiment limits the quantity of intake air into the engine 10 to thereby reduce the compression reaction force in each cylinder 10C.

Figure 10:
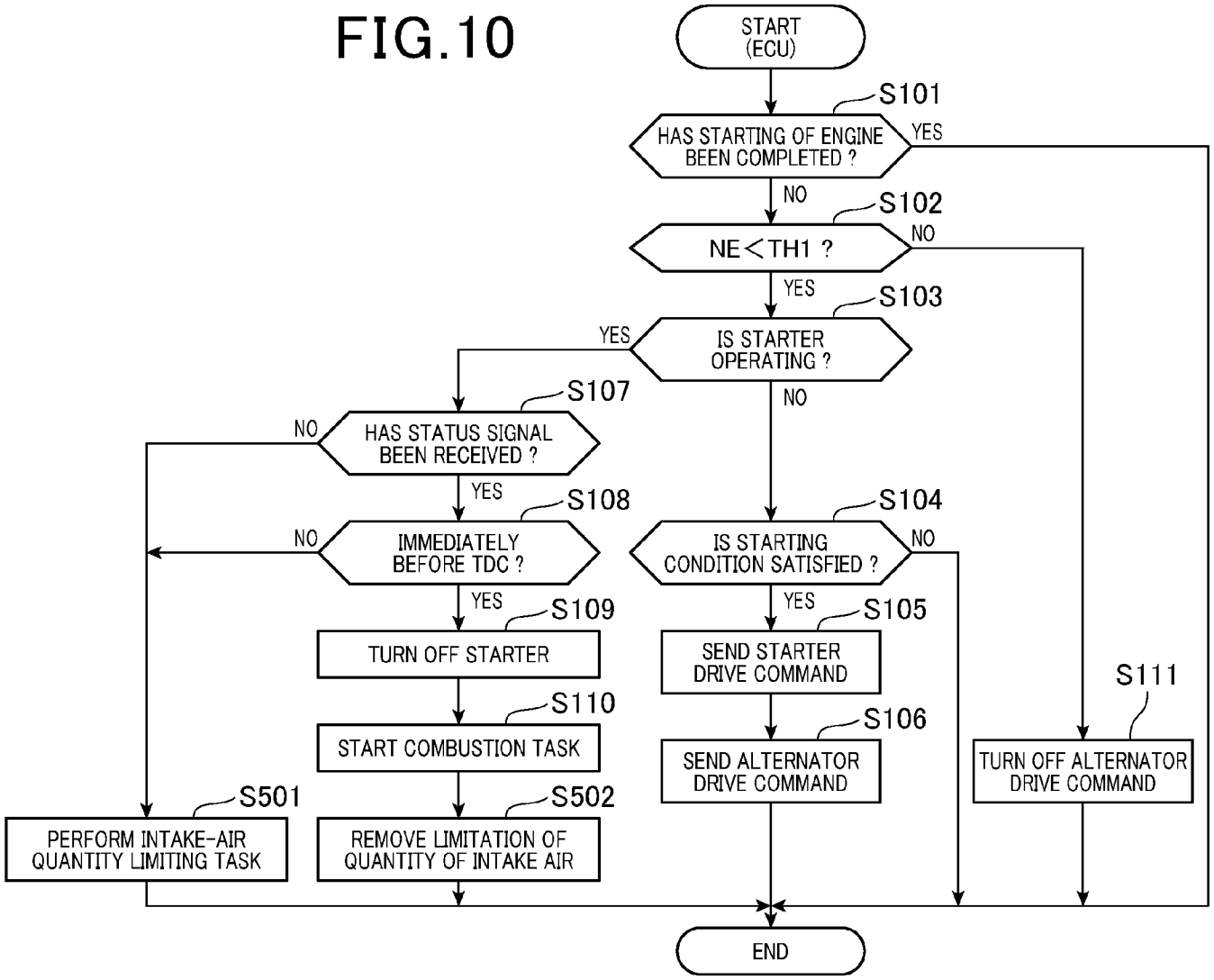
FIG. 10 is a flowchart schematically illustrating a first starting routine periodically carried out by the ECU illustrated in FIG. 1 according to the fourth embodiment of the present disclosure.

FIG. 10 schematically illustrates the first engine starting routine according to the fourth embodiment repeatedly carried out by the ECU 30 in the first control period. The operations in steps S501 and S502 are added to the first engine starting routine according to the first embodiment illustrated in FIG. 2.

When it is determined that starting of the engine 10 has not been completed (NO in step S101), the engine rotational speed NE is lower than the predetermined threshold TH1 (YES in step S102), and the starter 11 is operating (YES in step S103), the first engine starting routine proceeds to step S107.

At that time, when it is determined that the ECU 30 has not received the power-running mode start signal or that the rotational angular position of the rotating shaft 13 is located outside of the predetermined high-pressure angular range (NO in step S107 or S108), the first engine starting task proceeds to step S501.

In step S501, the ECU 30 performs the intake-air quantity limiting task set forth above. The intake-air quantity limiting task is configured to, for example, adjust the angular position of the throttle valve of the throttle valve system TV relative to a fully closed position at which the vehicle V can be moving at the idling speed. For example, the ECU 30 adjusts the angular position of the throttle valve of the throttle valve system TV relative to the fully closed position, thus limiting the quantity of intake air into the engine 10.

As another example, the intake-air quantity limiting task is configured to control a variable valve actuation system VAS provided in the engine 10 to adjust the opening and/or closing timing of the intake valves of the respective cylinders 10C, thus limiting the quantity of intake air into the engine 10. For example, the variable valve actuation system VAS is usually configured to close the intake valve for each cylinder 10C at its intake bottom dead center (BDC). At that time, the intake-air quantity limiting task is configured to control the variable valve actuation system VAS to adjust the opening and/or closing timing of the intake valve of each cylinder 10C to be earlier than the intake BDC, thus limiting the quantity of intake air into the engine 10.

The throttle valve system TV or the variable valve actuation system VAS serves as an intake-air quantity control mechanism.

In contrast, when it is determined that the ECU 30 has received the power-running mode start signal and that the rotational angular position of the rotating shaft 13 is located within the predetermined high-pressure angular range (YES in step S107 or S108), the first engine starting routine proceeds to step S110. In step S110, the ECU 30 starts the combustion task T1 including the fuel injection control task and ignition timing control task for each cylinder 10C after the present time.

Thereafter, in step S502, the ECU 30 removes the limitation of the quantity of intake air into the engine 10, i.e. terminates the intake-air quantity limiting task, which has been carried out in step S501. This increases the quantity of intake air into the engine 10, thus ensuring a sufficient amount of intake air into each cylinder 10C of the engine 10 required for the combustion task T1 for corresponding cylinder 10C.

That is, the operations in steps S501 and S502 enable the intake-air quantity limiting task, which limits the quantity of intake air into the engine 10 to a predetermined small quantity, to be carried out within the period from the start of activation of the starter 11 until the combustion task T1 is carried out.

As described above, the ECU 30 is configured to limit the quantity of intake air into the engine 10 until the power running operation of the alternator 21 has been started (YES in step S107). This configuration reduces the compression reaction force in each cylinder 10C to thereby reduce torque acting on the slidably contacted surfaces of the pinion 12 and ring gear 14, resulting in less gear noise. The ECU 30 is also configured to withdraw the limiting of the quantity of intake air into the engine 10 after determining that the power running operation of the alternator 21 has been started. This configuration prevents adverse effects on the combustion task T1 after the power running operation of the alternator 21, thus improving the startability of the engine 10.

Modifications

The engine starting systems according to each of the above-described embodiments is configured to use the motor-generator apparatus 20 with no rotational sensors, but use a motor-generator apparatus with a rotation sensor. That is, the rotation sensor can be configured to repeatedly measure the rotational speed of the rotor 21*a* of the alternator 21, and repeatedly output the measured rotational speed of the rotor 21*a* of the alternator 21. Then, the control IC 22 can determine, based on the measured rotational speed sent from the rotation sensor, whether it has recognized rotation of the rotor 21*a* of the alternator 21 since authorization of the power running operation of the alternator 21 in step S204*b*.

Similarly, the control IC 22 can determine whether the alternator 21 has operated in the power running mode as a function of the measured rotational speed sent from the rotation sensor. That is, the control IC 22 can determine that the alternator 21 has operated in the power running mode when determining that an estimated value of the engine rotational speed NE based on the measured rotational speed sent from the rotation sensor increases to be higher than the cranking rotational speed of the rotating shaft 13.

A known tandem starter including a first solenoid for shifting a pinion and a second solenoid for rotating a motor can be used as the starter 11.

While the illustrative embodiments of the present disclosure have been described herein, the present disclosure is not limited to the embodiments described herein, but includes any and all embodiments having modifications, omissions, combinations (e.g., of aspects across various embodiments), adaptations and/or alternations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. An engine starting system for controlling a first starting device gear-connected to a rotating shaft of an internal combustion engine of a vehicle, and a second starting device including a rotor belt-connected to the rotating shaft of the internal combustion engine, rotation of the rotating shaft of the internal combustion engine reciprocating a piston in a cylinder to compress a mixture of air and fuel in the cylinder, the engine starting system comprising:

a first controller configured to activate, in response to a driver's starting request, the first starting device to rotate the rotating shaft of the internal combustion engine; and a second controller communicably connected to the first controller and configured to:

recognize rotation of the rotor of the second starting device resulting from an activation of the first starting device; and start a power running operation of the second starting device to rotate the rotor based on the recognition of the rotation of the rotor, the first controller being configured to:

determine whether the power running operation of the second starting device has been started; and deactivate, when it is deter mined that the power running operation has been started, the first starting device before a rotational angular position of the rotating shaft of the internal combustion engine arrives at a position corresponding to a compression top dead center of the internal combustion engine.

2. The engine starting system according to claim 1, wherein:

the second controller is configured to:

send, to the first controller, a status signal after the rotation of the rotor of the second starting device resulting from the activation of the first starting device has been recognized, the status signal representing at least one of:

the rotation of the rotor of the second starting device; and start of the power running operation of the second starting device; and the first controller is configured to:

receive the status signal; and determine whether the power running operation of the second starting device has been started based on the received status signal.

3. The engine starting system according to claim 2, wherein:

the second starting device comprises a plurality of coils that rotate the rotor when energized;

the second controller is configured to:

send, to the first controller, at least one of a rotation recognition signal, a phase recognition signal, and a power-running operation start signal as the status signal after the rotation of the rotor of the second starting device resulting from the activation of the first starting device has been recognized, the rotation recognition signal representing that the rotation of the rotor of the second starting device resulting from the activation of the first starting device has been recognized, the phase recognition signal representing a phase of one of the plurality of coils that should be energized, the power-running operation start signal representing that start of the power running operation of the second starter has been recognized; and the first controller is configured to:

receive the at least one of the rotation recognition signal, phase recognition signal, and power-running operation start signal; and determine whether the power running operation of the second starting device has been started based on the at least one of the rotation recognition signal, phase recognition signal, and power-running operation start signal.

4. The engine starting system according to claim 3, wherein:

the first controller is configured to:

determine whether a predetermined relay time has elapsed since receiving of the at least one of the rotation recognition signal, phase recognition signal, and power-running operation start signal; and deactivate the first starting device upon determining that the predetermined delay time has elapsed since receiving of the at least one of the rotation recognition signal, phase recognition signal, and power-running operation start signal.

5. The engine starting system according to claim 1, wherein:

the first and second starting devices are connected to a power source installed in the vehicle, the first and second devices being configured to receive power supplied from the power source; and the first controller is configured to:

monitor how a state change parameter has changed since the activation of the first starting device, the state change parameter including:

at least one of an amount of discharge from the power source; and an amount of power supply to the first staring device; and determine whether the power running operation of the second starting device has been started based on how the state change parameter has been changed since the activation of the first starting device.

6. The engine starting system according to claim 1, wherein:

the second controller comprises:

a control circuit; and a driver including a plurality of switching elements, the control circuit being configured to control on-off switching operations of the switching elements of the driver to control a rotational speed of the rotor of the second starting device; and the first controller is configured to:

monitor how a temperature of at least one of the switching elements has increased since the activation of the first starting device; and determine whether the power running operation of the second starting device has been started based on how the temperature of the at least one of the switching elements has increased since the activation of the first starting device.

7. The engine starting system according to claim 1, wherein:

the first controller is configured to:

monitor a flow rate of intake air into the cylinder of the internal combustion engine has increased since the activation of the first starting device; and determine whether the power running operation of the second starting device has been started based on how the flow rate of intake air into the cylinder of the internal combustion engine has increased since the activation of the first starting device.

8. The engine starting system according to claim 1, wherein:

the first controller is configured to set, after determining that the power running operation of the second starting device has been started, a timing to deactivate the first starting device to be before a maximum compression-pressure timing at which a compression pressure in the cylinder is maximized.

9. The engine starting system according to claim 1, wherein:

the first controller is configured to:

control, after deter mining that the power running operation of the second starting device has been started, a fuel injection system installed in the internal combustion engine to start injection of fuel into the cylinder of the internal combustion engine before a rotational speed of the rotating shaft is within a predetermined resonance engine rotational speed range, the resonance engine rotational speed range corresponding to a predetermined resonance frequency range of the internal combustion engine.

10. The engine starting system according to claim 9, wherein:

the first controller is configured to:

determine, after it is deter mined that the power running operation of the second starting device has been started, whether a rate of increase of the rotational speed of the rotating shaft is lower than a predetermined threshold rate;

control the fuel injection system to start injection of fuel into the cylinder of the internal combustion engine before the rotational speed of the rotating shaft is within the predetermined resonance engine rotational speed range upon determining that the rate of increase of the rotational speed of the rotating shaft is lower than the predetermined threshold rate; and control the fuel injection system to start injection of fuel into the cylinder of the internal combustion engine after the rotational speed of the rotating shaft is within the predetermined resonance engine rotational speed range upon determining that the rate of increase of the rotational speed of the rotating shaft is equal to or higher than the predetermined threshold rate.

11. The engine starting system according to claim 1, wherein:

the first controller is connected to an intake-air quantity control mechanism installed in the internal combustion engine, the intake-air quantity control mechanism being configured to control a quantity of intake air into the cylinder of the internal combustion engine, the first controller being configured to control the intake-air quantity control mechanism to perform limitation of the quantity of intake air into the cylinder of the internal combustion engine to a predetermined limited quantity before determining that the power running operation of the second starting device has been started.

12. The engine starting system according to claim 11, wherein:

the first controller is configured to control the intake-air quantity control mechanism to remove the limitation of the quantity of intake air into the cylinder of the internal combustion engine after determining that the power running operation of the second starting device has been started.

* * * * *